US005961051A

United States Patent [19]

Matsui et al.

[11] Patent Number: 5,961,051

[45] Date of Patent: Oct. 5, 1999

[54] SHOWER APPARATUS

[75] Inventors: Hideyuki Matsui; Masatoshi Enoki, both of Kitakyushu, Japan

[73] Assignee: Toto Ltd., Fukuoka, Japan

[21] Appl. No.: 08/849,239

[22] PCT Filed: Oct. 31, 1996

[86] PCT No.: PCT/JP96/03189

§ 371 Date: Jun. 16, 1997

§ 102(e) Date: Jun. 16, 1997

[87] PCT Pub. No.: WO97/16105

PCT Pub. Date: May 9, 1997

[30] Foreign Application Priority Data

Oct. 31, 1995 [JP] Japan ..... 7-283220

[51] Int. Cl.[6] ..... B05B 1/30

[52] U.S. Cl. ..... 239/533.1; 239/570; 239/574; 137/505; 137/509

[58] Field of Search ..... 239/67, 68, 435, 239/533.1, 533.15, 562, 570, 574, 583; 137/505, 509; 138/30, 31

[56] References Cited

U.S. PATENT DOCUMENTS

| | | | |
|---|---|---|---|
| 594,787 | 11/1897 | Gallagher | 239/583 |
| 1,536,531 | 5/1925 | Schermann | 239/570 |
| 2,208,031 | 7/1940 | Hooper | 239/570 |
| 3,512,525 | 5/1970 | Crowley, Jr. et al. | 239/570 |

FOREIGN PATENT DOCUMENTS

| | | | |
|---|---|---|---|
| 1104448 | 4/1961 | Germany | 239/583 |
| 58-32753 | 7/1983 | Japan . | |
| 58-53118 | 12/1983 | Japan . | |
| 4-102660 | 9/1992 | Japan . | |
| 6-5588 | 1/1994 | Japan . | |
| 7-24363 | 1/1995 | Japan . | |
| 7-55211 | 6/1995 | Japan . | |

*Primary Examiner*—Andres Kashnikow
*Assistant Examiner*—Jorge S. Bocanegra
*Attorney, Agent, or Firm*—Jordan and Hamburg LLP

[57] ABSTRACT

A shower apparatus reduces the effects of water hammer within a portion of a flow route connecting a shower head to a supply, when a flow adjusting mechanism proximal the shower head is operated. The shower apparatus adjusts pressure of a supply fluid dependant upon the degree of throttling of the flow route and the flow adjusting mechanism controls the amount of flow of the supply fluid dependant upon a degree of opening thereof to the discharge end of a shower head. The structure providing the pressure adjustment and the flow adjusting mechanism are each disposed successively from upstream of the flow route, between a shower side flow route provided in a water plug and the shower head or a discharge end of the shower head. The shower apparatus further cushions the pressure against an increase in the internal pressure of the flow route which occurs when the flow route is closed by the flow adjusting mechanism, and is provided as a flow route system capable of cushioning an increase in the internal pressure of the flow route when the flow amount adjusting means is operated. An increase in pressure due to water hammer which occurs when flow of water feeding is terminated is suppressed, preventing the otherwise excessive pressure from acting on respective parts including the shower hose, thereby serving to prolong an original pressure resistance of the shower hose and maintain proper continued function of components downstream of the water plug.

22 Claims, 22 Drawing Sheets

SHOWER APPARATUS

BACKGROUND OF THE INVENTION

This invention relates to a shower apparatus in which a shower head portion thereof contains an opening valve, a flow adjusting valve and the like and, more particularly, a shower apparatus designed to resist damage by water hammer or the like which may occur when such valve is closed.

General types of shower apparatuses provided in bathrooms contain a shower head connected to a hot water/cold water mixing plug through a hose.

Turning-on and stopping of the water flow is carried out by means of a select handle on a hot water/cold water mixing plug or an opening valve provided in the shower head as disclosed in Japanese Utility Model Publication No. Sho 58-53118.

If the opening valve is suddenly closed in the type in which water feeding and discharge are carried out on the shower head side, water hammer occurs in the primary side of the opening valve, i.e., in a flow route between the hose and the hot water/cold water mixing plug. If water hammer occurs, pressure in the internal flow route rises and at the same time, the pressure changes suddenly. As a result, deterioration in pressure resistance of the hose is induced by vibration of the hose or increase in the internal pressure thereof.

To solve the water hammer problem, it is effective to provide the water plug side with a pressure responding valve or the like for cushioning an increase in the internal pressure as disclosed in Japanese Utility Model Publication No. Sho 58-32753. With the pressure responding valve, a chamber sectioned by a diaphragm is made to communicate with the flow route up to the water discharge device, and the increase in internal pressure which occurs when a valve containing this water discharge device is closed is absorbed by deformation of the diaphragm.

As a mechanism for preventing the aforementioned water hammer phenomenon, various methods are already known, and structures for absorbing or releasing an increase in internal pressure as disclosed in the preceding patent publication are basic ones.

In addition to the above described mechanism for preventing water hammer, as disclosed in Japanese Unexamined Utility Model Publication No. Hei 6-5588, a pressure adjusting valve for adjusting the pressure of mixing water to be fed to the shower head is incorporated in the flow route in the upstream end of the shower hose so that primary side pressure is not applied to the shower hose when the opening valve of the shower head is closed.

If an opening valve for discharging water and stopping thereof is provided, the main body of the shower head is held by one hand and the knob of the opening valve is operated by the other hand. In this case, it is preferable from the viewpoint of usability that operations for stopping the discharge of water, and inverse operations, can be carried out quickly. Thus, a mechanism which opens and closes the flow route all at once by employing a push-button type opening valve is employed so as to quicken valve closure.

If the opening valve closes quickly, the amount of water hammer is increased and the internal pressure on the hose side in the downstream end is changed largely all at once, so that loading of the internal pressure to the hose when water hammer occurs is consistently repeated. It is effective to apply the pressure responding valve as disclosed in the preceding patent publications corresponding to such water hammer.

However, although a diaphragm for absorbing changes in pressure can stabilize pressure in the hose by elastic deformation of the diaphragm even after the pressure responding valve has been closed, the effect thereof in reducing a rise in pressure just after water hammer occurs is limited. Further, if a valve body is provided which is activated to temporarily expand the volume of the internal flow route in correspondence with an increase in pressure, and at the same time close the internal flow route, it is also possible to suppress the increase in pressure which occurs when water hammer occurs. However, after this valve body is moved, response to changes in pressure tend to be inferior to elastic deformation of the diaphragm, so that the effect of stabilizing the pressure in the hose is consequently reduced.

Although the diaphragm type is suitable for stabilization after a change in pressure, the effect of attenuation of an increase in pressure due to water hammer tends to be inferior. On the other hand, although a solid type valve body is preferable for attenuation of rise in pressure, it is not entirely effective for subsequent stabilization of the pressure in the hose. Thus, no conventional types of pressure responding valves using diaphragms or valve bodies are sufficiently effective during the occurrence of water hammer.

For this reason, a type which contains an opening valve in its shower head, even though the pressure responding valve is contained in flow route, is not capable of effectively suppressing an increase in the internal pressure in the hose at the time water flow is stopped. This results in problems, such as accelerated deterioration due to pressure resistance fatigue of the hose.

On the other hand, in a type which contains a pressure adjusting valve in the flow route in the upstream end of the shower hose, when an opening valve provided in the shower head in the form of a hand-operated valve is closed, water hammer occurs in the shower hose, and thereby induces an increase in internal pressure eventually leading to deterioration or damage of the shower hose.

The internal pressure of the shower hose when water is stopped by the hand-operated valve changes variously depending on the closure speed thereof. The value of internal pressure in the shower hose when water is stopped by the hand-held operation on the shower head end is basically determined by a specification of the pressure adjusting valve. However, when the hand-operated valve is closed all at once, the pressure adjusting valve is closed with a high internal pressure in the shower hose because water hammer also occurs, and such high internal pressure is subsequently maintained after valve closure. Thus, load on the shower hose is increased thereby inducing deterioration or damage.

In a type of shower apparatus in which the pressure adjusting valve is improved by reducing its size by combination of the piston and cylinder, hydraulic pressure is sometimes applied in a direction of opening the valve due to a clearance between the piston and the cylinder. Thus, if water is stopped by hand-held operation of a valve on the shower head when the supply water pressure is high, a force keeping the valve of the pressure adjusting valve closed is weakened, and unless the internal pressure in the shower hose is high, it is not possible to stop the supply of water by means of the pressure adjusting valve.

Furthermore, because a function of the pressure adjusting valve is to hold the secondary pressure at a constant value by adjusting an amount of flow to the shower head, the higher the supply pressure on the water supply side, the more the flow route of the pressure adjusting valve is throttled. Thus, if the supply pressure is high, the velocity of flow when water passes through a throttled flow route is increased. If the pressure adjusting valve is closed while this condition is present, a significant water hammer occurs.

Even if the pressure responding valve and the pressure adjusting valve or the like are equipped to prevent occurrence of water hammer as described above, if the feed of water is stopped by the hand-held operation of the valve on the shower head side, a temporary rise of the internal pressure in respective parts including the shower hose is unavoidable.

An object of the present invention is to suppress an increase in pressure due to water hammer which may occur particularly when the feed of water is stopped, in a shower apparatus in which discharge of water and stopping of water is carried out on the shower head side, and thereby reduce pressure applied to respective parts including the shower hose, thereby maintaining continued viability of the parts.

SUMMARY OF THE INVENTION

The present invention comprises a pressure adjusting means for adjusting the pressure of supply fluid, and a flow amount adjusting means for adjusting an amount of flow of the supply fluid depending on the degree of opening thereof to a discharge end of the shower head, the pressure adjusting means and the flow amount adjusting means being disposed successively from the upstream end of a flow route between a shower side flow route provided in a water plug and a shower head or a discharge end of the shower head. The present invention further comprises a pressure cushioning means for cushioning an increase in the internal pressure of the flow route which occurs when the flow route is closed by the flow amount adjusting means, provided as a flow route system capable of cushioning an increase in the internal pressure of the flow route when the flow amount adjusting means is operated.

According to the above described construction, it is possible to dispose a pressure cushioning means for cushioning an increase in the internal pressure of the flow route which may occur from a water plug when the pressure adjusting means closes the flow route. Further it is possible to incorporate an opening valve as a flow amount adjusting means in the shower head and which further contains an operating portion.

By including such pressure cushioning means, the increase in the internal pressure of the hose when the valve is closed on the shower head end is absorbed and the pressure cushioning means provided in the shower head or a flow route up to the pressure adjusting valve suppresses an increase in the internal pressure, thereby reducing the load from changes in pressure acting upon the hose.

In a type of shower apparatus in which the pressure cushioning means comprises a control valve body in a pressure adjusting valve and a pressure chamber, an increase in pressure which occurs when an opening valve such as that in a shower head is closed is absorbed by expansion of the volume, thereby preventing an increase in the internal pressure of the hose.

Because the control valve body which serves as the pressure adjusting means can be moved in a direction such that the internal volume of the pressure chamber is increased even after the flow route from a fluid supply source is shut down when the internal pressure of the hose is increased, an increase of the internal pressure which cannot be absorbed by the cushioning means on the shower head side is restricted and absorbed by the pressure adjusting valve.

In a type of shower apparatus in which a variable volume structure is utilized as a pressure cushioning means, by making a small hole in a bore open to a throat in an orifice on an internal flow route, a pressure transmitted to a variable volume body or the like can be reduced, thereby simplifying constructional considerations relating to strength and structure.

In a type of shower apparatus in which a leak mechanism is utilized as a pressure cushioning means, only the opening valve mechanism may be a special device, so that the opening valve and the pressure cushioning means can be combined. Further, in a valve switching mechanism type in which the opening valve is switched to the discharge side and water stopping side, if the leak mechanism is disposed in the flow route of the water stopping side, it is possible to release an increase in pressure which occurs at the time water flow is stopped or when the opening valve is closed through the leak mechanism.

In a type of shower apparatus in which a mild stopping mechanism is utilized as a pressure cushioning means, an occurrence of water hammer is eliminated because rapid closing of the opening valve never occurs, thereby making it possible to maintain a further stabilized maintenance of the internal pressure.

Further, in a type of shower apparatus in which the opening valve is opened or closed by thrust lock mechanism, shower operation can be implemented only by pressing the operating portion once by hand. If the operating portion is pressed again, it is possible to stop operation of the shower.

The above, and other objects, features and advantages of the present invention will become apparent from the following description read in conjunction with the accompanying drawings, in which like reference numerals designate the same elements.

BRIEF DESCRIPTION OF THE DRAWINGS

FIG. 3(*b*) shows an example of a stroke action of a control body as in FIG. 2 in which water is stopped by packing disposed in a circumference of the control valve body fittable to an internal circumference of the valve hole.

FIG. 13(*b*) is a detailed longitudinal sectional view taken along the lines A—A in FIG. 13(*a*).

FIG. 13(*c*) is an expansion view of slits made in a circumferential wall of a guide ring.

FIG. 22(*b*) is a diagram of the packing shown in FIG. 21 showing a positional relation of the packing with respect to the valve hole in the valve seat.

DETAILED DESCRIPTION OF THE INVENTION

Figure 1:
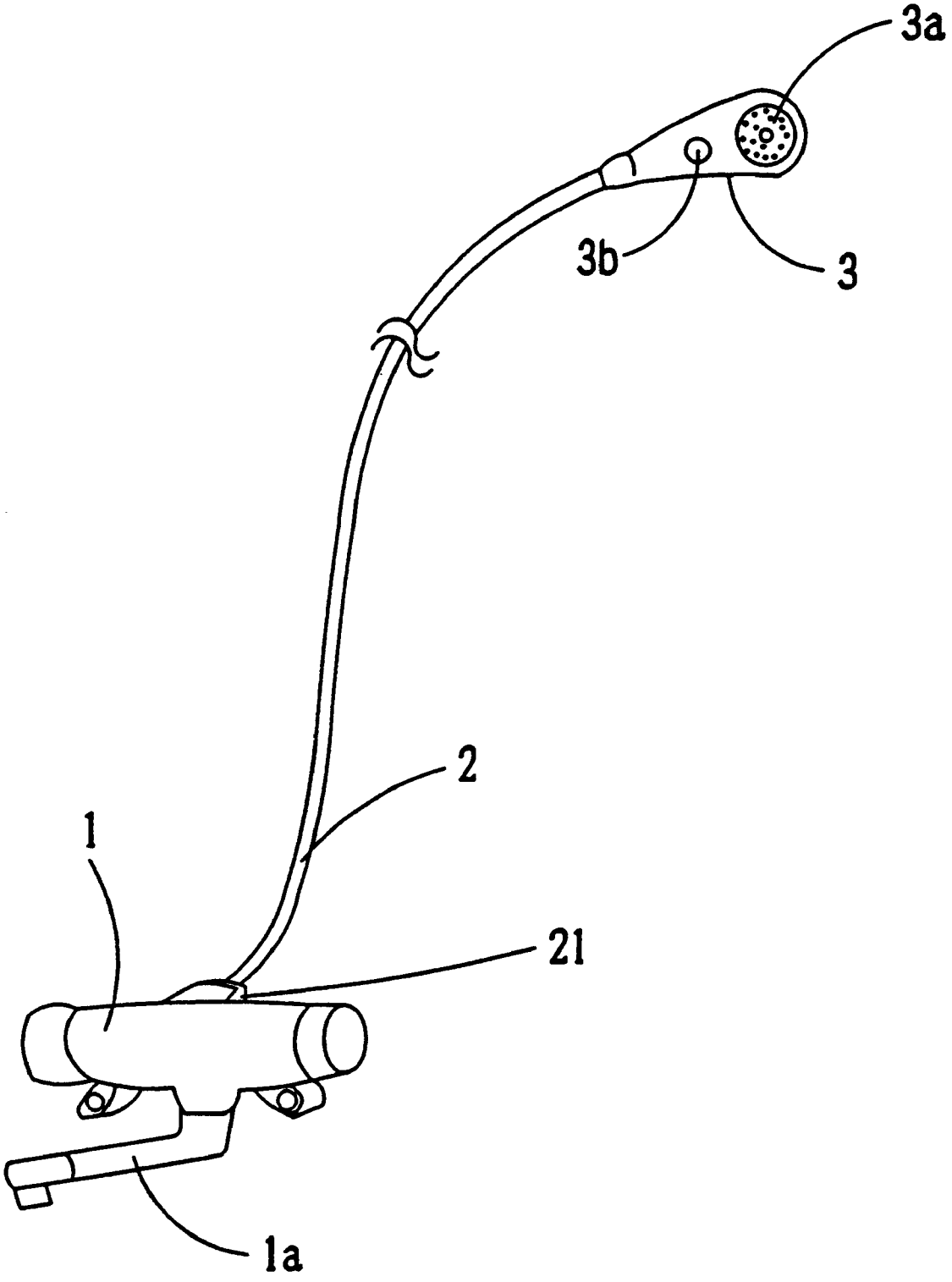
FIG. 1 is a schematic view showing a system in which a shower apparatus of the present invention is connected to a hot water/cold water mixing plug.

FIG. 1 is a drawing showing a scheme of a general example of a shower apparatus.

Referring to the figures, and in particular FIG. 1, a general example of a shower apparatus is depicted therein. In the shower apparatus, a shower head 3 is connected to a hot water/cold water mixing plug 1, for example, fixed to a wall of a bathroom, through a hose 2. The hot water/cold water mixing plug 1 receives supplies of hot water and cold water, and can change a flow route to a discharge pipe 1*a* or a hose 2 in a conventional manner.

The shower head 3 is connected to the hose 2 at its proximal end and has a spray plate 3*a* at its flow route end. According to the present invention, an operation portion 3*b* for supply and stopping of mixing water to the spray plate 3*a* is provided. This operation portion 3*b* is suitably structured to only carry out discharge and stopping of water by opening or closing the flow route or to be capable of adjusting the flow of water by changing the degree of opening of its valve.

Between a mixing water exit 1*b* of the hot water/cold water mixing plug 1 and the hose 2, a pressure adjusting valve 21 is provided which absorbs a rise in internal pressure when the valve is closed by the operation portion 3*b* of the shower head 3. As shown in the transverse sectional view of FIG. 2, this pressure adjusting valve 21 contains a partition wall 21*a* which partitions a side of the mixing water exit 1*b* from a portion communicating with the hose 2. At a portion which is around a valve hole 22 made in the partition wall 21*a* and which faces a chamber on a side of the mixing water exit 1*b*, a packing 23 is provided.

At a flow route on a side of the mixing water exit 1*b* relative to the partition wall 21*a*, a pressure chamber 24 is provided which is disposed on the same axis as the valve hole 22. In this pressure chamber 24, a control valve body 25, for absorbing a rise in pressure when the valve is closed and water flow is stopped, is incorporated to face the partition wall 21*a* so as to be able to advance or retract. This control valve body 25 can slide along a guide 24*a* protruding from the pressure chamber 24 toward the partition wall 21*a* in a water-tight condition, and is also slidable in water tight conditions with respect to an internal wall of the pressure chamber 24, so that it is urged in a direction leaving the partition wall 21*a* by a spring 26. The control valve body 25 contains a communication route 25*a* provided from a front end thereof facing a flow route on the valve hole 22 side to a rear end thereof in an axial direction and a space 27 formed between the pressure chamber 24 and the sliding portion of the control valve body 25 is made to communicate with a flow route from the mixing water exit 1*b* to the hose 2 by means of this communicating route 25*a*.

At a front end of the control valve body 25 a cone 25*b* is formed having a shape which gradually narrows toward an end thereof as shown in FIG. 39(*a*). At a rear portion thereof from its proximal end is a sliding portion 25*c* having the same diameter, allowing sliding within the guide 24*a*. The packing 23 provided around the valve hole 22 has an internal diameter which can stop water with the sealing circumference of the sliding portion 25*c* when it is inserted into the valve hole 22.

If the flow route is opened by the operation portion 3*b* of the shower head 3, mixing water is supplied from the hot water/cold water mixing plug 1 and flows through the valve hole 22 in the pressure adjusting valve 21, and into the hose 2. Depending on the throttling of the valve hole 22, the velocity of water flow back and forth therethrough increases so that the pressure around the front end of the cone 25*b* of the control valve body 25 drops. Thus, internal pressure in the space 27 communicating therewith through the communication route 25*a* also drops, so that the control valve body 25 is held at the position shown in FIG. 2 by the force of the spring 26, and then the supply of mixing water through the valve hole 22 to the hose 2 is continued.

If the flow route is closed by means of the operation portion 3*b* of the shower head 3, the internal pressure in the flow route of the hose 2 increases. At such time, the stream of mixing water is also stopped and thus the pressure around the valve hole 22 becomes equal to the internal pressure of the hose 2. The increase of pressure after the valve is closed is transmitted to the space 27 through the communication route 25*a* in the control valve body 25. Thus the internal pressure in this space increases so as to contract the spring 26. Consequently the control valve body 25 moves toward the valve hole 22 and, as shown in FIG. 3(*a*), the sliding portion 25*c* engages the packing 23 thereby shutting down the flow route.

This action of the control valve body 25 not only shuts the flow route to the hose 2 but also increases an internal volume of the space 27 formed between the control valve body 25 and the pressure chamber 24. Because this space 27 communicates with the flow route on a side of the hose 2 even after the flow route is shut down, the increase in the internal pressure can be absorbed by an increase in volume of the space 27. According to this embodiment, the pressure adjusting valve 21 is so structured to contain a pressure adjusting function by respective actions of the control valve body and pressure cushioning function, for coping with a time when the internal pressure in the flow route is increased. The pressure adjusting means and pressure cushioning means are integrally constructed.

Figure 3A:
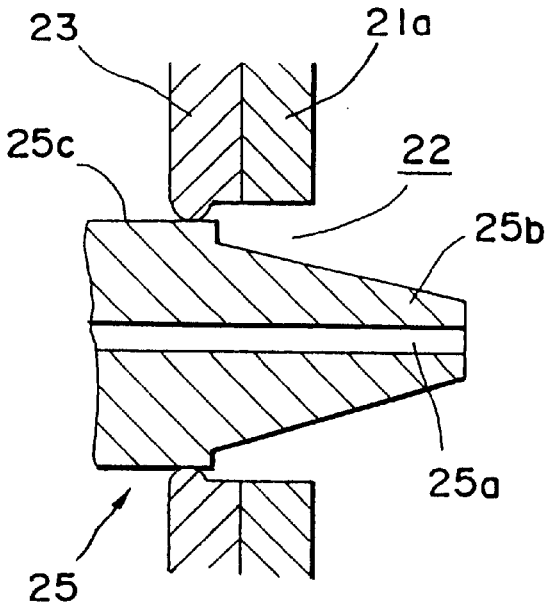
FIG. 3(*a*) shows an example of a stroke action of a control body as in FIG. 2 in which water is stopped by a sliding portion of the control valve body and a packing on the valve hole side.
Figure 3B:
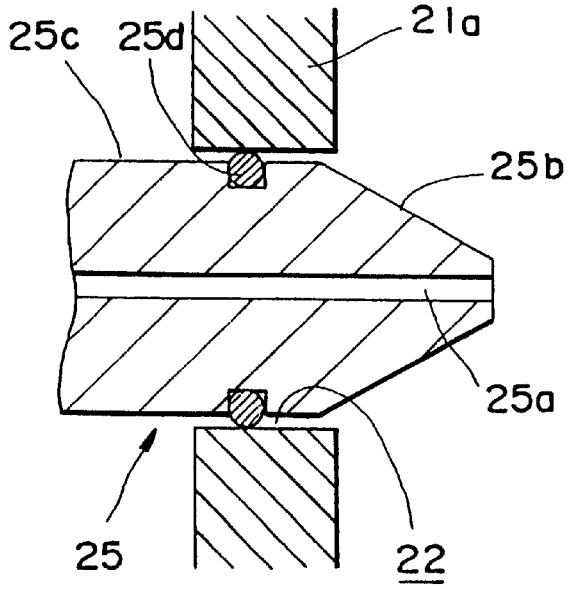

Although the valve hole 22 is completely shut in a state shown in FIG. 3(*a*), the control valve body 25 can be moved further rightward from the indicated state. The control valve body 25 moves freely corresponding to propagation of pressure to the space 27 to cope with an increase in pressure or pulsation just after the valve of the shower head side is closed, in order to absorb that increase in pressure by changing the volume of the space 27.

Even if the mixing water supplied from the mixing water exit 1*b* is of high pressure, it flows into the space 27 through the communication route 25*a* in the control valve body 25 so that the control valve body 25 is moved to the side of the valve hole 22, resisting the force of the spring 26. If the control valve body 25 is moved so as to enter the valve hole 22, the flow amount is throttled, so that hydraulic pressure in the communication route 25*a* and the space 27 drops and the control valve body 25 is thereby stabilized at such a position that the hydraulic pressure is balanced with the spring 26. Thus, even if high pressure mixing water is supplied, stabilized low pressure mixing water is supplied to the hose 2 by the pressure adjusting valve 21.

When high pressure mixing water is supplied, when an opening valve 5 of the shower head 3 is closed, the pressure in the space 27 increases in the above example, so that the control valve body 25 is moved from the position in which a balance with the spring 26 is obtained toward the valve hole 22 thereby shutting the valve hole 22. Thus the hose 2 is separated from the high pressure mixing water, and thus only a slightly higher pressure than the constant pressure when the valve is opened is applied, thereby preventing the hose from deterioration or damage.

The spring 26 should have a force such that hydraulic pressure at the side of the hose 2 is less than 1 kg/cm2 when water is made to pass, and a spring constant and number of windings of coils such that the hydraulic pressure is less than 2 kg/cm2 when water feeding is stopped.

An action for stopping water supply and absorbing pressure by the control valve body 25 is enabled by a relation between the sliding portion 25*c* of the control valve body 25 and the valve hole 22 as shown in FIG. 3(*b*). In this example, the length in axial direction of the valve hole 22 is quite long and the packing 25*d* comprising an O-ring or the like is suitably structured to enter the valve hole 22 as shown therein when the internal pressure in the flow route is increased, thereby stopping water flow. Further, because such an action of changing the volume of the space 27 is achieved by moving the control valve body 25 in a stroke in which the packing 25*d* is located within the valve hole 22, it is possible to carry out absorption of pressure according to the internal pressure in the flow route.

As described above, after the control valve body 25 shuts down the flow route as well, the space 27 is made to communicate with the hose 2 through the communication route 25*a*, and the control valve body 25 itself can move freely in its stroke direction. Thus, even if the increase in pressure continues after the valve of the shower head is closed, this increase of pressure is absorbed so as to reduce the pressure load on the hose 2.

Figure 4A:
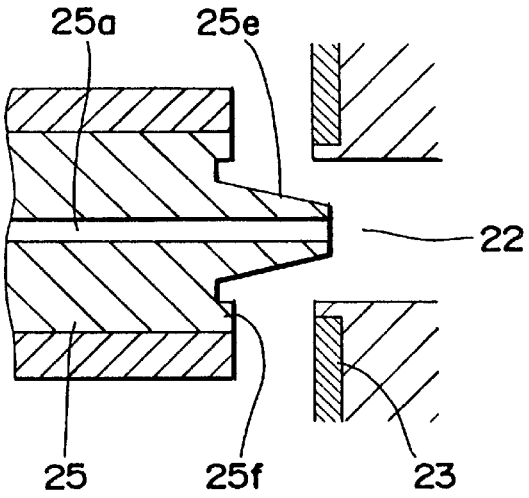
FIGS. 4(*a*) and 4(*b*) show an example in which a cone is provided on the front end of the control valve body, and provides schematic views for explaining a phenomenon where the speed of closing the valve is increased when water hammer occurs on a hose side.
Figure 4B:
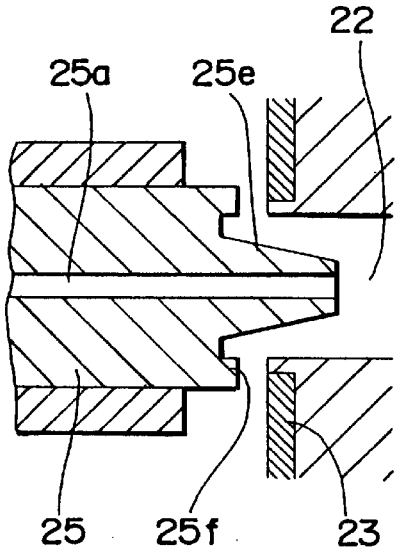

FIGS. 4(*a*), 4(*b*), 5(*a*) and 5(*b*) are schematic views for explaining whether reduction of pressure load by water hammer applied to the side of the hot water/cold water mixing plug is enabled, depending on the difference in the shape of the front end of the control valve body 25.

Referring to FIG. 4, the packing 23 provided around the valve hole 22 is different from the packing shown in FIG. 3 in that the former is disposed in an annular shape for receiving only the front portion of the control valve body 25, and stops water flow by an engagement of the control valve body 25 with the packing 25. The front portion of the control valve body 25 is formed in a conical shape 25*e* and annular settling ring 25*f* is disposed at a proximal portion of this cone 25*e* so as to protrude therefrom. When the control valve body 25 is moved to water flow stopping position, this settling ring 25*f* is structured so as to strike an end face of the packing 23.

The control valve body 25 having such a cone 25*e* is also maintained at a position in which the secondary side pressure is balanced with the spring 26 when water is being fed as in the previous example. For example, when the primary side pressure is normal and the position in which the cone 25*e* is maintained is as shown in FIG. 4(*a*), when the primary side pressure is high, a velocity of flow around a throttle portion between the circumference of the cone 25*e* and the valve hole 22 increases so that pressure applied to this portion is decreased and, at the same time, the internal pressure of the space 27 rises. Thus, the control valve body 25 is moved to a position shown in FIG. 4(*b*) and is balanced there such that the distance between the settling ring 25*f* and the packing 23 is reduced.

If water flow is stopped by the operation portion 3*b* of the shower head 3, the pressure in the space 27 increases so that the control valve body 25 is moved further rightward and the settling ring 25*f* is fit to the packing 23 so as to close this valve. At this time, because the distance between the settling ring 25*f* and the packing 23 is reduced, the opening speed of the valve is increased so that consequently a rise in pressure due to water hammer on the side of the hot water/cold water mixing plug 1 is increased.

Figure 5A:
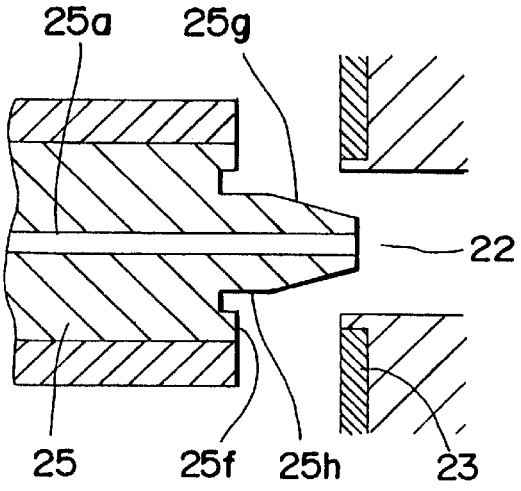
FIGS. 5(*a*) and 5(*b*) are schematic views showing an example in which the speed of closing the valve is decreased by using a different shape of control valve body from that shown in 4(*a*) and 4(*b*).
Figure 5B:
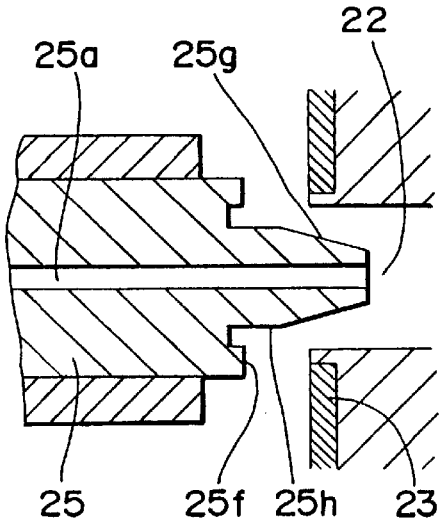

Alternatively, although in the control valve body shown in FIGS. 5(*a*) and 5(*b*) the shape of the settling ring 25*f* and the like is the same as shown in FIG. 4, the cone 25*g* is provided only on its front end portion and the axial length thereof is less than the cone 25*g* shown in FIGS. 4(*a*) and 4(*b*). Further, a portion which is located at the proximal end and protruding slightly from a portion surrounded by the settling ring 25*f* so as to connect to the cone 25*g* is a straight portion 25*h* having an equal diameter. At a time of normal water feeding, as in the case shown in FIGS. 4(*a*) and (*b*), the control valve body 25 is balanced at a position shown in FIG. 5(*a*).

By providing the cone 25*g* only on the front end of the portion protruding from the settling ring 25*f*, when the control valve body 25 is located at a position shown in FIG. 5(*b*) when the primary side pressure is increased, the control valve body 25 is balanced at a position farther apart from the packing 23 as compared to the example shown in FIGS. 4(*a*) and 4(*b*). This is because the degree of throttle by the cone 25*g* with respect to the valve hole 22 is larger than the example shown in FIG. 4. Thus, the distance between the packing 23 and the settling ring 25*f* is greater, so that the closing speed of the valve of the control valve body 25 when water hammer occurs due to stopping of water flow on the shower head side is lowered as compared to the example shown in FIGS. 4(*a*) and (*b*), thereby cushioning a rise of internal pressure in the hot water/cold water mixing plug 1.

Figure 6A:
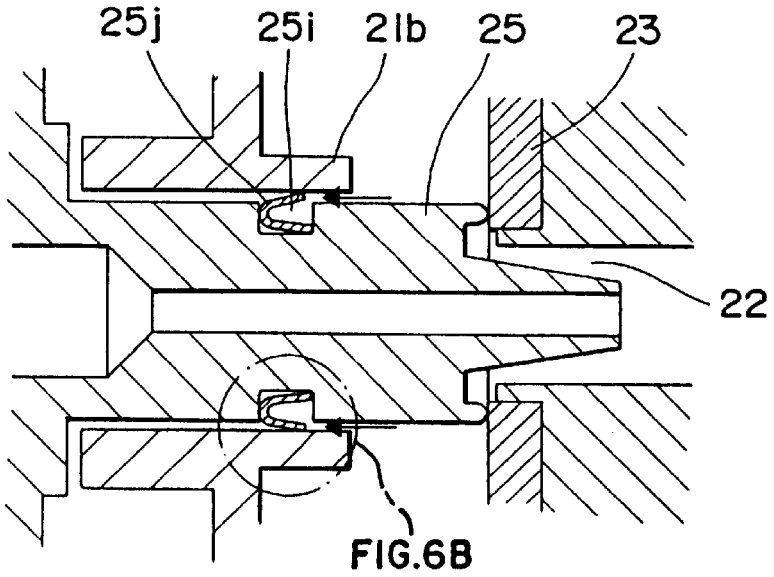
FIG. 6 is a longitudinal sectional view of major parts illustrating how a U-shaped packing is provided in an external circumference of the control valve body, and how the control valve body is pushed in a direction for opening the valve by a primary side pressure.
Figure 6B:
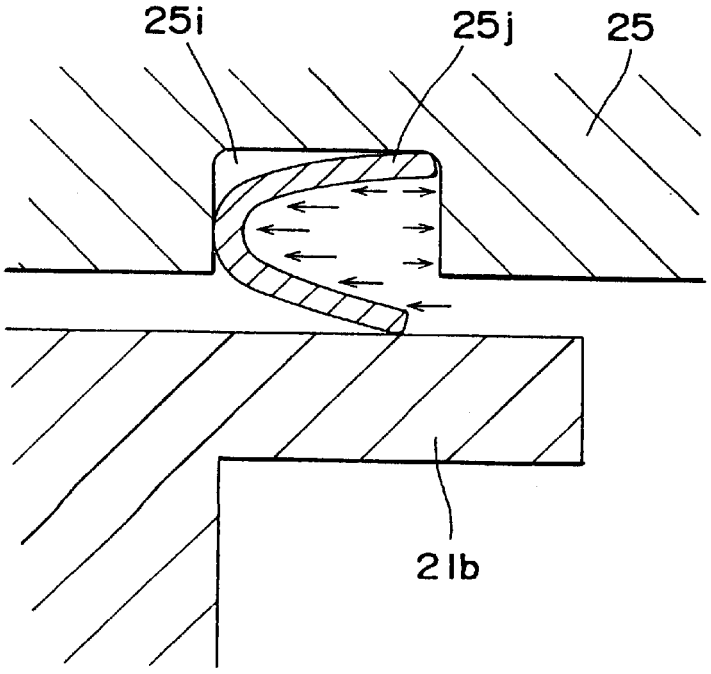
Figure 7:
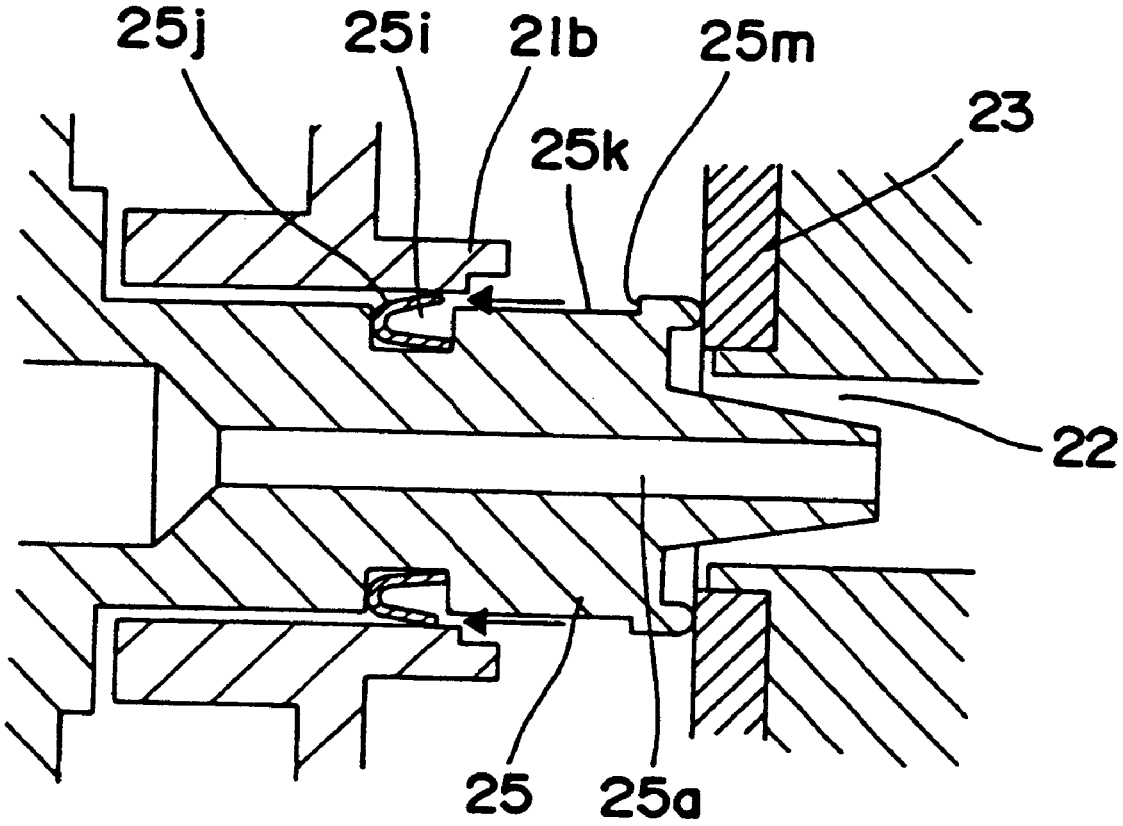
FIG. 7 is a longitudinal sectional view of major parts showing a case in which, by balancing the operating force on the packing by primary side pressure instead of the control valve body shown in FIG. 6, closing of the valve with stabilized operation of the control valve body is realized.

FIGS. 6, 7 are drawings for explaining whether reduction of the internal pressure in the hose 2 when water feeding on the shower head side 3 is stopped is enabled, the depicted embodiment being distinguished from a preceding embodiment by a difference in the sealing structure between the control valve body 25 and the guide 21*b* for guiding this control valve body 25.

Referring to FIG. 6, a control valve body 25, having substantially the same external diameter as the internal diameter of a cylindrical guide 21*b* formed on the same axis as the valve hole 22, is incorporated in the interior of the pressure adjusting valve 21 so as to be slidable thereon, and packing 25*j*, having a U-shaped cross section, is embedded in an annular groove 25*i* formed in the external circumferential face of the control valve body 25. The packing 25*j* is incorporated so that the face directed to the front end of the control valve body 25 is in the form of a concave cross section. Thus, the primary side pressure acts in a manner pressing the packing 25*j* to the left as shown by the enlargement in FIG. 6 through a clearance between the control valve body 25 and the guide 21*b*.

In accordance with this embodiment, when water feeding in the shower head 3 is stopped, the internal pressure in the hose 2 is transmitted to the space 27 in a manner tending to urge the control valve body 25 to the right in order to close the valve. However, because the primary side pressure acts on the packing 25*j* and a pressure loading area thereof is larger than an end face of the annular groove 25*i*, the control valve body 25 receives a load pushing to the left, i.e. a direction that the valve is opened, by the primary side pressure. Thus, if the primary side pressure is high, the force of the control valve body 25 in the direction of valve opening increases so that the force on the settling ring 25*f* pushing against the packing 23 lessens.

If the force of the control valve body 25 to contact the packing 23 lessens, there is a possibility that the control valve body 25 may temporarily leave the packing 23 when water hammer occurs, so that the primary side pressure is transmitted into the hose 2. Consequently, the internal pressure of the hose 2 increases rapidly.

Alternatively, the control valve body 25 shown in FIG. 7 has a smaller diameter portion 25*k* which extends from the annular groove 25*i* to near the settling ring 25*f* and has an external circumferential face smaller than the previous example. At an end portion of this smaller diameter portion 25*k* a pressure receiving face 25*m* is formed directed opposite to the settling face of the settling ring 25*f*. An external diameter of the portion forming this pressure receiving surface 25*m* is structured to be slightly smaller than the internal diameter of the guide 21*b* and by this device, it is possible to make total acting area of the end face of the annular groove 25*i* and the pressure receiving surface 25*m* equal to the acting area in which the primary side pressure applied to the packing 25*j* acts. Thus, the primary side pressure which pushes the packing 25*j* to the left is balanced with the end face of the annular groove 25*i* and the primary side pressure pushing the pressure receiving surface 25*m*. As a result, if the primary side pressure is high, it is possible to maintain a state in which the control valve body 25 is pushed securely against the packing 23.

By forming the control valve body 25 in such a shape that the primary side pressure to the control valve body 25 is attenuated in a direction of opening the valve, it is possible to keep the control valve body 25 closed even when the primary side pressure is high, thereby making it possible to reduce a rise in the internal pressure in the hose 2.

Figure 8:
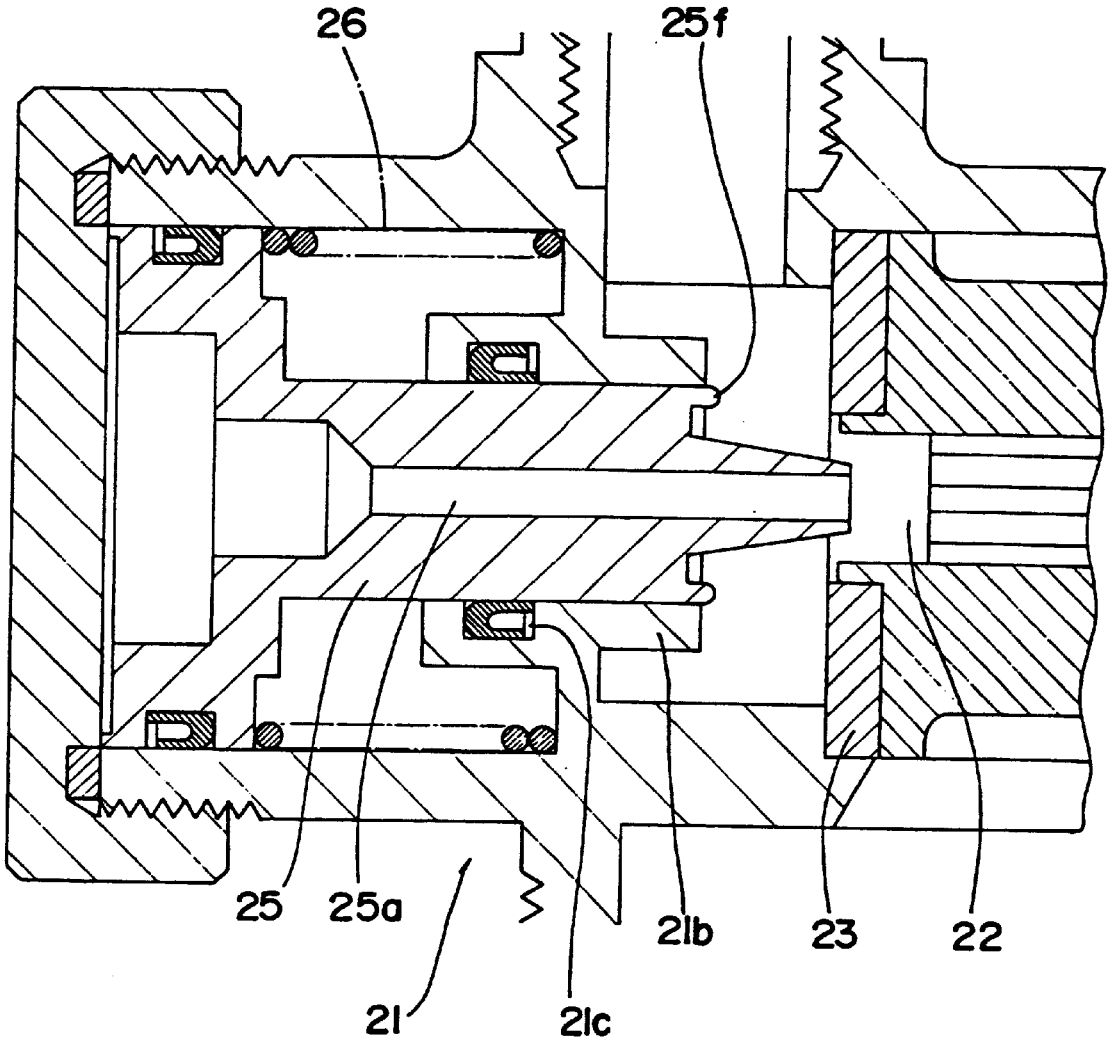
FIG. 8 is a longitudinal sectional view of major parts showing an embodiment in which, by providing an internal circumference of a guide for guiding the control valve body with a U-shaped packing, the load on the control valve body in the direction for opening of the valve by the primary side pressure is eliminated.

FIG. 8 is a longitudinal sectional view showing an example in which the packing 21*d* having a U-shaped cross section is embedded in the annular groove 21*c* provided in the internal circumference of the guide 21*b*.

In the examples shown in FIGS. 6, 7, the packing 25*i* is provided in the annular groove 25*j* formed in the control valve body 25. Thus, if the primary side pressure is high, the control valve body 25 is pushed in the direction of opening the valve by a load received by this packing 25*i*.

In the example shown in FIG. 8, the packing 21*d* is contained in the guide 21*b* side and the control valve body 25 is structured such that the external circumference thereof is made to slide relative to the packing 21*d*. Even if the primary side pressure is so high that the load acts on the packing 21*d* through the clearance between the control valve body 25 and the guide 21*b*, the control valve body 25 only acts as a pressure receiving face in which the settling ring 25*f* located at the front end provides the maximum diameter. The load acting on the packing 21*d* only increases sliding resistance of the control valve body 25 relative to the circumference thereof and produces no action for moving the control valve body 25 in the direction of opening the valve. Thus, even if the primary side pressure is high, it is possible to reduce a rise in pressure in the hose 2 and the hot water/cold water mixing plug 1 due to water hammer produced when water feeding is stopped in the shower head 3.

Figure 2:
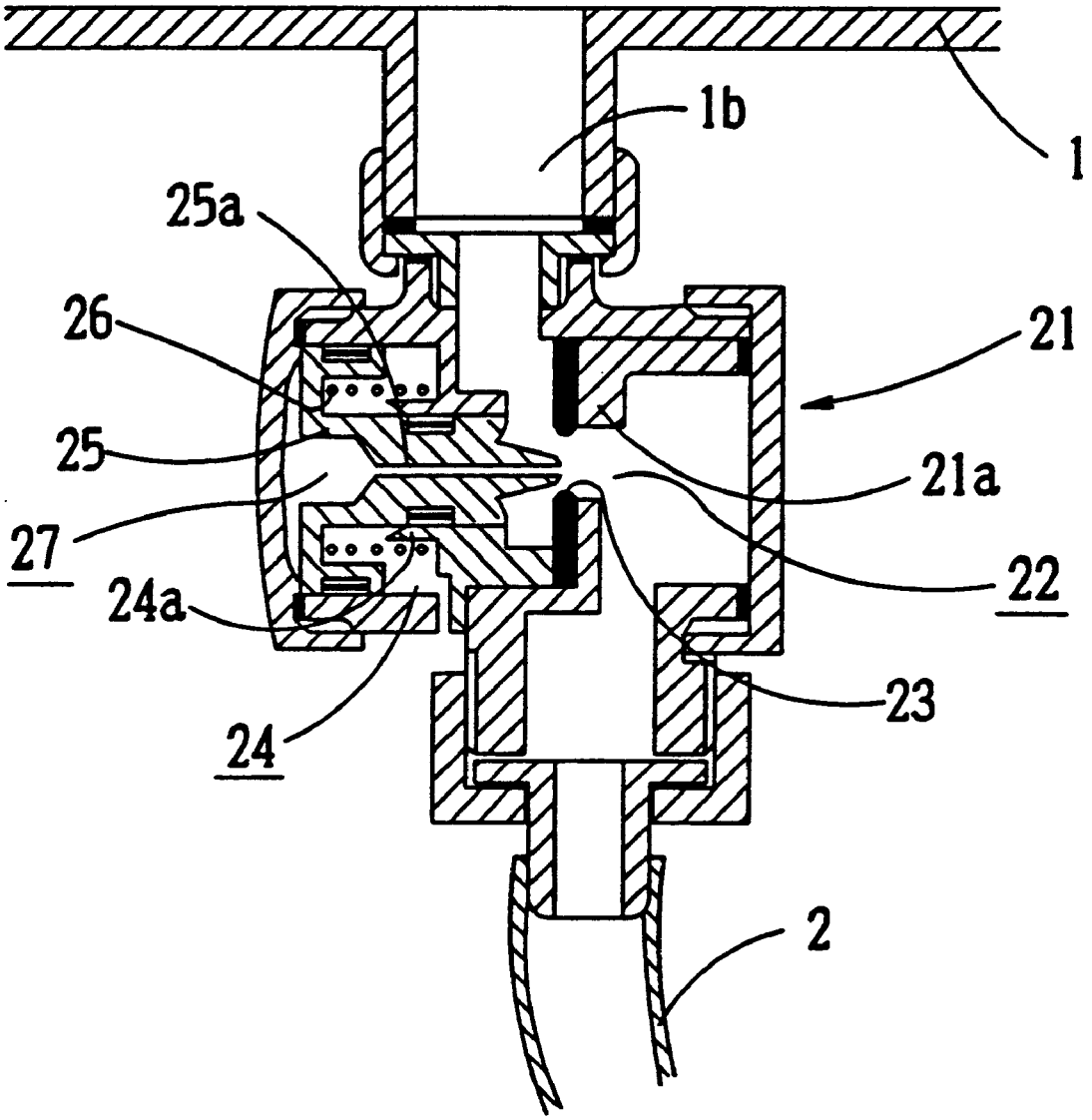
FIG. 2 is a transverse sectional view of major parts for absorbing pressure by means of a pressure responding valve disposed between a mixing water exit and the hose of a hot water/cold water mixing plug.
Figure 9:
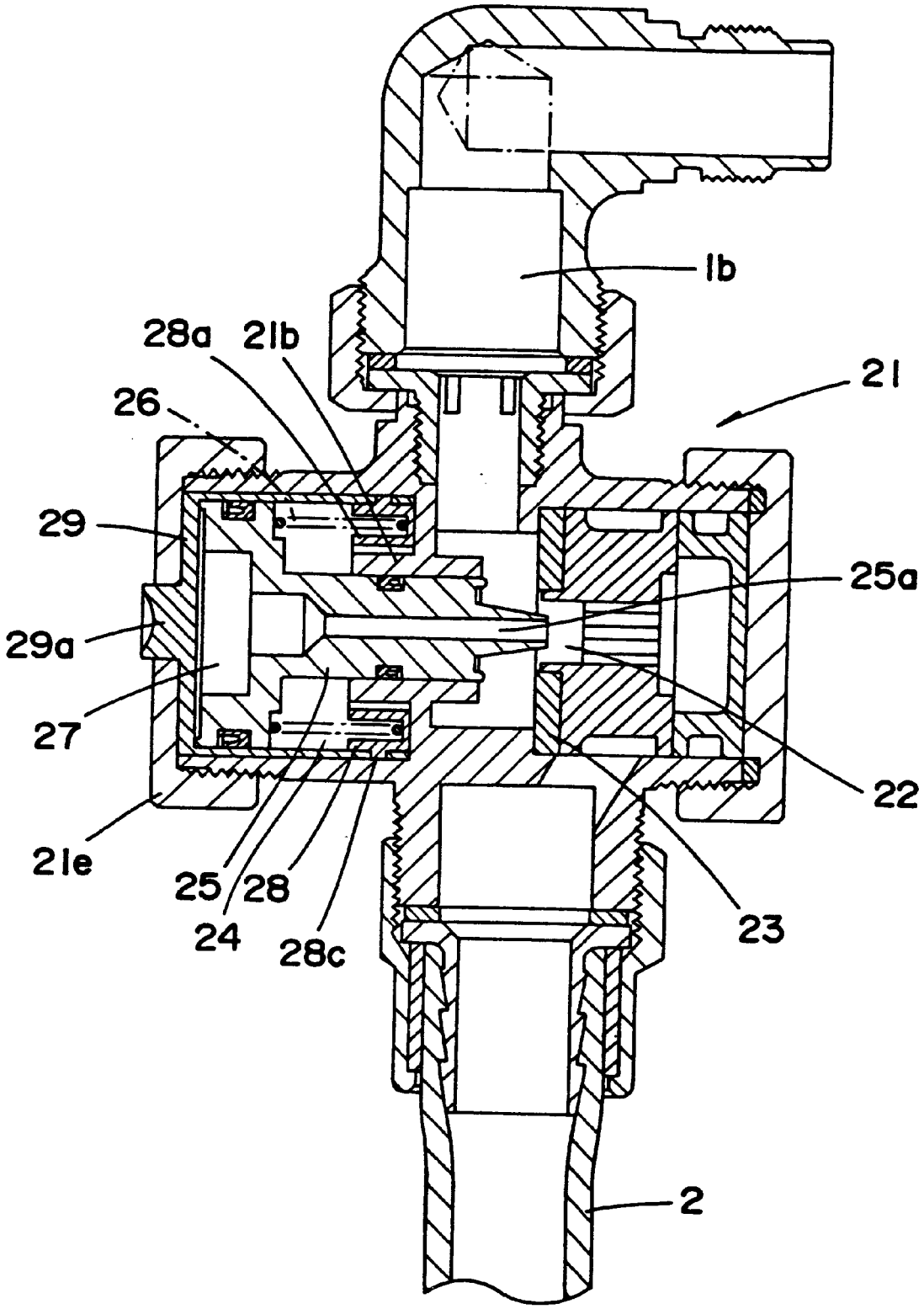
FIG. 9 is a longitudinal sectional view of major parts of a pressure adjusting valve structured so as to adjust the initial load of a spring for urging the control valve in the direction for opening the valve.

FIG. 9 is a longitudinal sectional view of major components showing a further practical embodiment of the pressure adjusting valve 21 shown in FIG. 2. The same components as previously shown are indicated by the same reference numerals and a detailed description thereof is omitted.

The control valve body 25 is disposed by the guide 21*b* so that it is retractable relative to the valve hole 22. An initial load of the spring 26 for urging the control valve body 25 in the direction of opening the valve can be adjusted.

For adjustment of the initial load of this spring 26, a moving element 28 is incorporated in the pressure chamber 24 and, at the same time, an operation element 29 which can be rotated from outside is provided.

Figure 10:
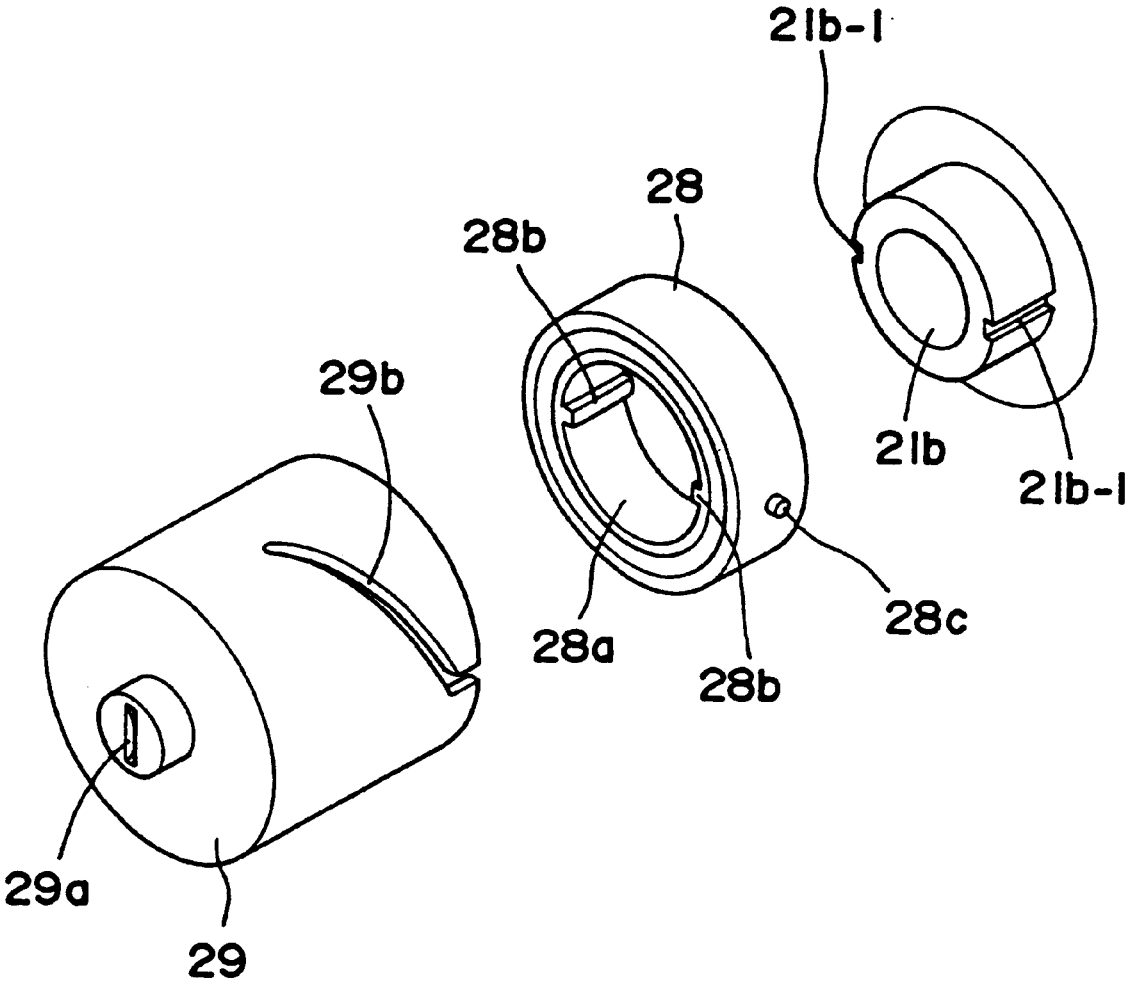
FIG. 10 is a perspective view of disassembled parts for adjusting the initial load of the spring shown in FIG. 9.

FIG. 10 is a disassembly perspective view of the guide 21*b*, the moving element 28 and the operation element 29.

At two positions on the external circumference of the guide 21*b* into which the control valve body 25 is to be inserted, slide grooves 21*b*-1 are formed in an axial direction. The moving element 28 has a sleeve 28*a* into which the guide 21*b* is slidably inserted from outside. By inserting protruding rails 28*b* provided on the internal circumference of this sleeve 28*a* into the guides 21*b*-1, the moving element 28 can be moved only in the axial direction without being rotated around the guide 21*b* and is provided with a protrusion 28*c* on the external circumference.

The operation element 29 is rotatably incorporated on the same axis as the pressure chamber 24 and a motion thereof in the axial direction is blocked by a plug 21*e* connected to an end face of the pressure adjusting valve 21. An internal circumference thereof serves as a sliding surface for the control valve body 25 in the axial direction and a sliding surface for the moving element in the rotation direction. A tool hooking portion 29*a* is provided in a portion protruding from the plug 21*e*, and a slit 29*b* is made in a portion of the operation element in which the moving element 28 is inserted, the slit being disposed from an end portion thereof toward the circumferential surface.

The slit 29*b* has an opening width allowing the protrusion 28*c* of the moving element 28 to be inserted therein and is developed in the circumferential direction having torsion with respect to the axis of the operation element 29. Thus, if the operation portion 29 is rotated clockwise as viewed in FIG. 10, the moving element 28 is moved to the left as viewed in the same figure due to the relative motion of the protrusion 28*c* within the slit 29*b*. If the operation element 29 is rotated counterclockwise, the moving element is moved to the right.

By providing the aforementioned configurations of moving element 28 and the operation element 29, the moving element 28 can be moved to the right and the left depending on the direction of the rotation of the operation element 29. The spring 26 is structured so that an end thereof strikes the proximal end of the control valve body and the other end thereof strikes the moving element 28. Thus, if the moving element 28 is moved to the left, compression of the spring 26 is enhanced. If the moving element 28 is moved to the right, the load on the spring 26 is reduced. Thus, even after the spring 26 is incorporated in the pressure adjusting valve 21, the initial load to the spring 26 can be changed by turning the operation element 29.

Because the initial load of the spring 26 can be easily set and changed, even if supplied hydraulic pressure changes, the restoration force of the spring 26 can be adjusted so as to reduce the internal pressure of the hose 2. As a result, it is possible to reduce a rise in pressure which occurs in the hose 2 and the hot water/cold water mixing plug when water feeding is stopped on the water head 3 side. Even if an error occurs in spring loading during production of the spring 26, by adjusting the initial load of the spring 26 it is possible to maintain the function of the pressure adjusting valve 21 notwithstanding such production error.

As described previously, when the primary side pressure is particularly high, the closing speed of the valve of the control valve body 25 which is induced when water feeding is stopped in the shower head 3 is increased so that water hammer occurs due to closing of the flow route by the control valve body 25. To reduce this water hammer, it is effective to decrease the internal diameter of the communication route 25*a*. For example, the internal diameter should preferably be about 0.3 mm–1.5 mm.

That is, when the control valve body 25 is moved toward the packing 23 or toward a position in which the valve is closed, the volume of the space 27 occupying the rear portion of the control valve body 25 is gradually increased. By the motion of this control valve body 25, a stream of water directed to the space 27 from the front end of the control valve body 25 is induced, accompanied by an increase in the volume of the space 27. Thus, if the flow of water directed to the space 27 is throttled by decreasing the internal diameter of the communication route 25*a*, the speed of the control valve body 25 can be decreased by utilizing resistance of water. Thus, it is possible to reduce water hammer which occurs when the control valve body 25 closes the valve. On the other hand, if the internal diameter of the communication route 25*a* is brought below 0.3 mm, the moving speed of the control valve body 25 is decreased. Even if the operation portion 3*b* of the shower head 3 is operated to open same, the opening speed of the control valve body 25 is decreased so that the spray of water from the shower head 3 is delayed.

When the control valve body 25 is closed, except in the examples shown in FIG. 3, the settling ring 25*f* strikes the surface of the packing 23 along the same axis. In this type of valve-closing, by decreasing the hardness of the packing 23, it is possible to move the control valve body 25 further, as in the example indicated in FIG. 3, so that it imbeds more securely in the packing 23, even after the valve is already closed.

The hardness of ordinary packing for use in valves used to stop the flow of water is about 90 degrees. Because this packing is always in a state in which the valve is closed and compressed and sometimes tightened excessively by manual operation, a packing produced according to specifications which resist deformation is utilized. Thus, it is preferable that the hardness of the packing 23 under respective embodiments is 40–70 degrees. If such a hardness is ensured, after the valve is closed, as described above, the control valve body 25 can be moved a little, thereby contributing to reduction of water hammer and further ensuring a high degree of sealing performance. If the hardness of the packing is less than 40 degrees, the strength of the packing is decreased so that external deformation is likely to be produced.

Figure 11:
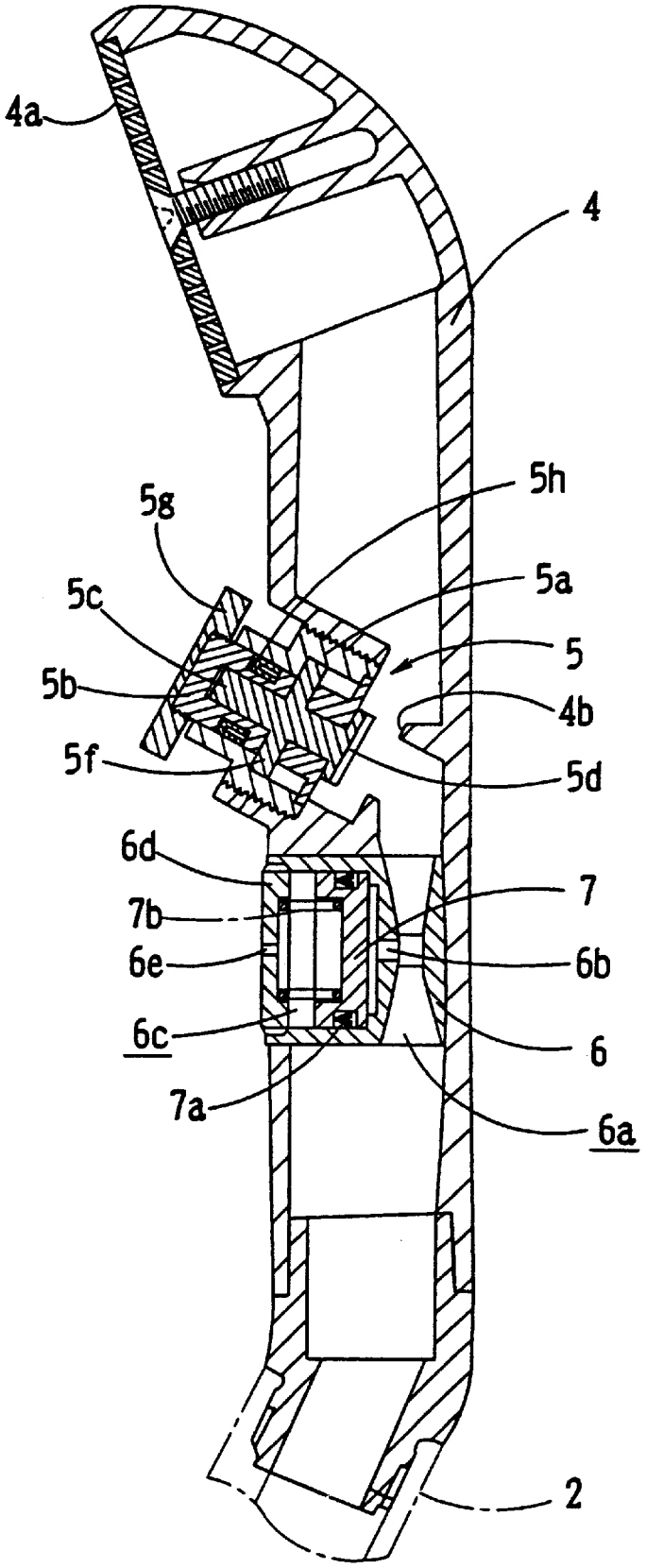
FIG. 11 is a longitudinal sectional view of an embodiment in which a pressure absorbing mechanism using a piston is employed upstream of the opening valve provided in the main body of the shower head.

FIG. 11 is a longitudinal sectional view of the shower head according to the present invention.

Like the shower head shown in FIG. 1, the hose 2 is connected to a proximal end of the main body 4 of the shower head and a spray plate 4*a* having a number of small holes is attached to its front end. An opening valve 5 is provided to open and close an inside flow route at a middle portion of the main body 4.

Figure 12:
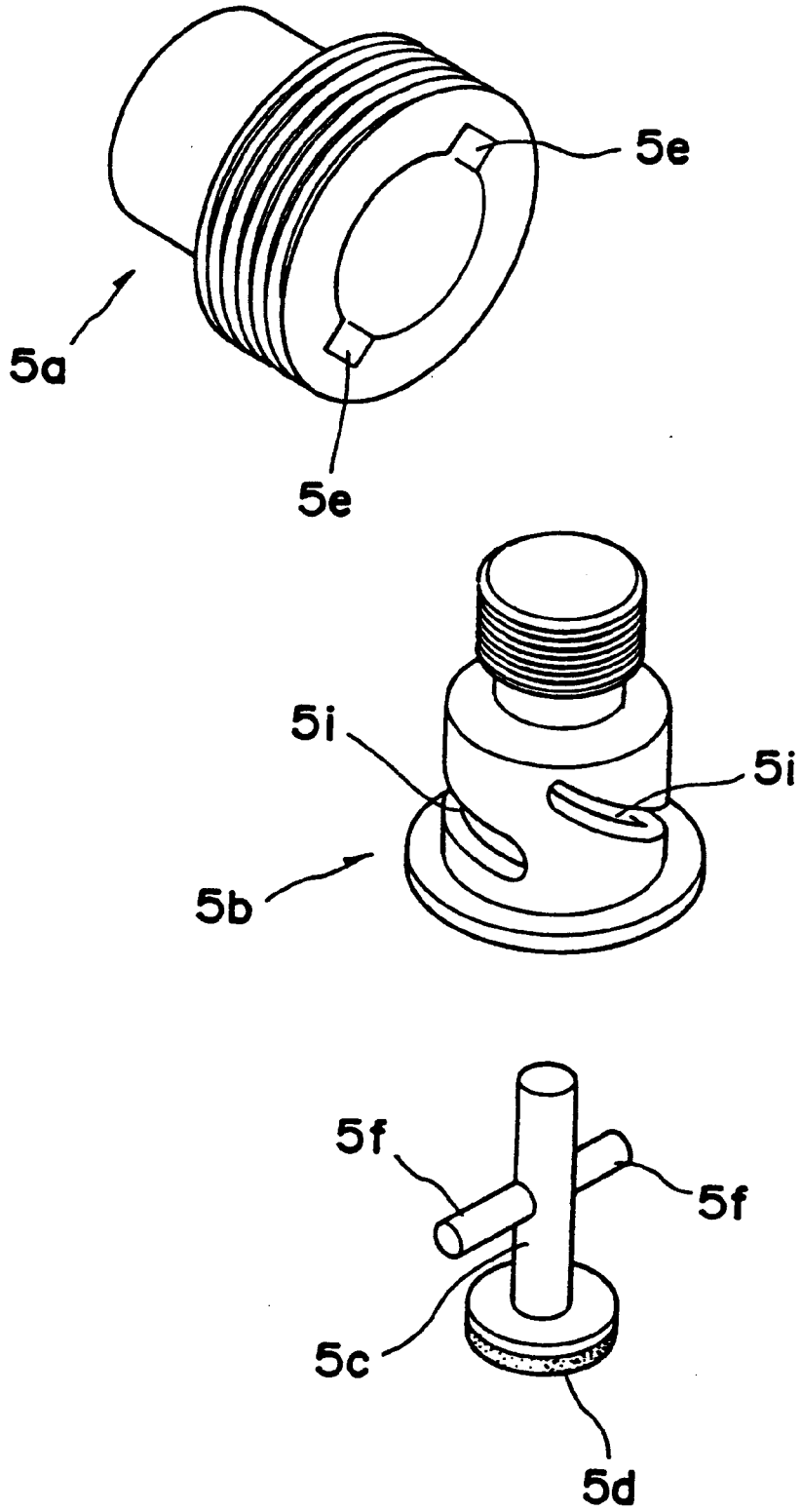
FIG. 12 is a disassembly perspective view of a sleeve, a guide and a spindle in the pressure absorbing mechanism shown in FIG. 11.
Figure 13A:
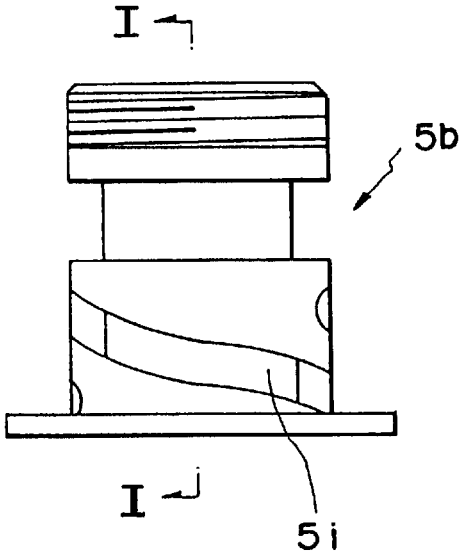
FIG. 13(*a*) is a detailed front view of a guide ring.
Figure 13B:
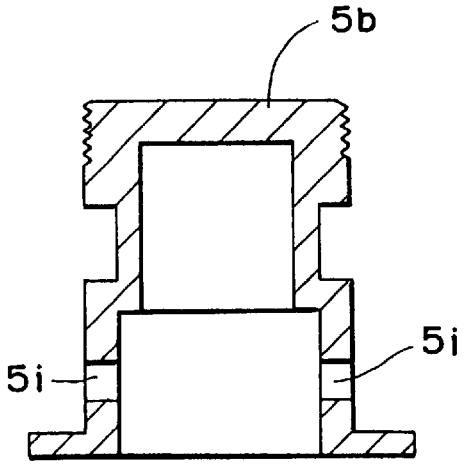
Figure 13C:
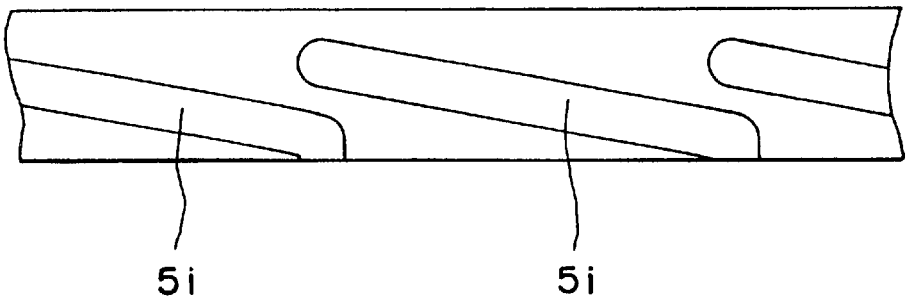

In the opening valve 5, a guide ring 5*b* is mounted on a sleeve 5*a* screwed to the main body 4 so that it is rotatable on the same axis as the sleeve 5*a* and, further, a spindle 5*c* is incorporated in this guide ring 5*b* so that it is rotatable on the same axis. The opening valve 5 is structured so that the packing 5*d* provided the same axis. The opening valve 5 is structured so that the packing 5*d* provided at the front end of the spindle 5*c* is separable as a valve disc from an annular FIG. 12 is a disassembly perspective view of the sleeve 5*a*, the guide ring 5*b* and the spindle 5*c* and FIG. 13(*a*), (*b*) and (*c*) are detail of the guide ring 5*b*.

The sleeve 5*a* is a hollow object having different diameters and, in an internal circumference of the lower half of the object, holding grooves 5*e* are radial direction and in the axial direction. The spindle 5*c* has two protrusions 5*f* radial direction and in the axial direction. The spindle 5*c* has two protrusions 5*f* which are incorporated slidably in the holding grooves 5*e* in the sleeve 5*a*. rotation operations and is incorporated in the sleeve 5*a* through a packing 5*h*. The guide ring 5*b* has a hollow interior in which the spindle 5*c* is inserted. Two guide ring 5*b* has a hollow interior in which the spindle 5*c* is inserted. Two circumferential direction as shown in FIG. 12 so that the protrusions 5*f* of the spindle 5*c* can be inserted into the slits 5*i*. As shown in the expansion drawing of FIG. 13(*c*), the slits 5*i* are formed obliquely relative to the axis of the guide ring 5*b*.

With respect to the sleeve 5*a* fixed to the main body 4, the guide ring 5*b* is freely rotatable around an axis thereof. By inserting the protrusions 5*f* of the spindle 5*c*, protruding through the slits 5*i* of this guide ring 5*b*, into the holding grooves 5*e* of the sleeve 5*a*, the spindle 5*c* cannot be rotated around the axis thereof as it is held by the protrusions 5*f* and the holding grooves 5*e* and can only thereof as it is held by the protrusions 5*f* and the holding grooves 5*e* and can only rotated, the protrusions 5*f* are moved relatively through the oblique slits 5*i* so that a position of the spindle 5*c* is changed along the axial direction. a position of the spindle 5*c* is changed along the axial direction.

In this opening valve 5, the spindle 5*c* is set from the state in which the packing 5*d* is settled on the valve seat 4*b* by turning the knob 5*g* only a half turn, because of the protrusion 5*f* and the slit 5*i*. Turning the knob 5*g* in the opposite direction opens the valve from the water stopping position.

To prevent a rise of internal pressure due to water hammer which occurs when the opening valve is opened, a pressure cushioning means is provided just upstream of the opening valve 5. This pressure cushioning means comprises a upstream of the opening valve 5. This pressure cushioning means comprises a therein.

In the block 6, an orifice 6*a* is formed for providing communication between the bottom end of the main body 4 and the valve seat 4*b* side, and a bore 6*c* for communicating with a throat portion of the orifice 6*a* through a small hole 6*b*. At an opening end of the bore 6*c*, a plug 6*d* having a small hole 6*e* is detachably mounted. A piston 7 is incorporated in the bore 6*c* through packings 7*a* in water-tight condition, urged toward the orifice 6*a* by a spring 7*b*.

With the above described structure, if the knob 5*g* is turned to close the opening valve 5 after a shower, the spindle 5*c* is moved rapidly toward the valve seat 4*b* as described previously, so that the packing 5*d* is settled on the valve seat 4*b* to shut down the water flow route. Although a rise in the internal pressure in the flow route is increased downstream of the opening valve 5 because of the shutdown of the flow route at this time, pressure is transmitted to the bore 6*c* communicating with the internal flow route through the small hole 6*b*. Then, the piston 7 receives this pressure so as to contract the spring 7*b*, and the piston is then moved to the left as shown in FIG. 11 so that the internal volume of the bore 6*c* residing on the side of the small hole 6*b* is increased.

As described above, an increase in pressure in the internal flow route which may occur when the opening valve 5 is closed is absorbed by an increase in the volume of the bore 6*c* communicating with the internal flow route downstream of the opening valve 5, thereby making it possible to suppress a rise in internal pressure which may occur just after the valve is closed. Thus, the load from internal pressure to the hose 2 is reduced so as to prevent deterioration of the pressure resistant properties and sealing performance of a joint.

The small hole 6*b* through which the bore 6*c* communicates with the internal flow route is opened to the throat portion in the orifice 6*a*. Attendant a rise in internal pressure, the increase in pressure in this throat portion is smaller when compared to a portion which has a large flow route area. Thus, transmission of pressure to the bore 6*c* is reduced and the spring 7*b* need only have an elasticity sufficient for allowing the piston 7 to move depending on the rise in the pressure. Thus, pressure resistance of the spring 7*b* can be minimized and the size of the spring 7*b* can be reduced, thus enabling a reduction in the size of the block 6.

Figure 14:
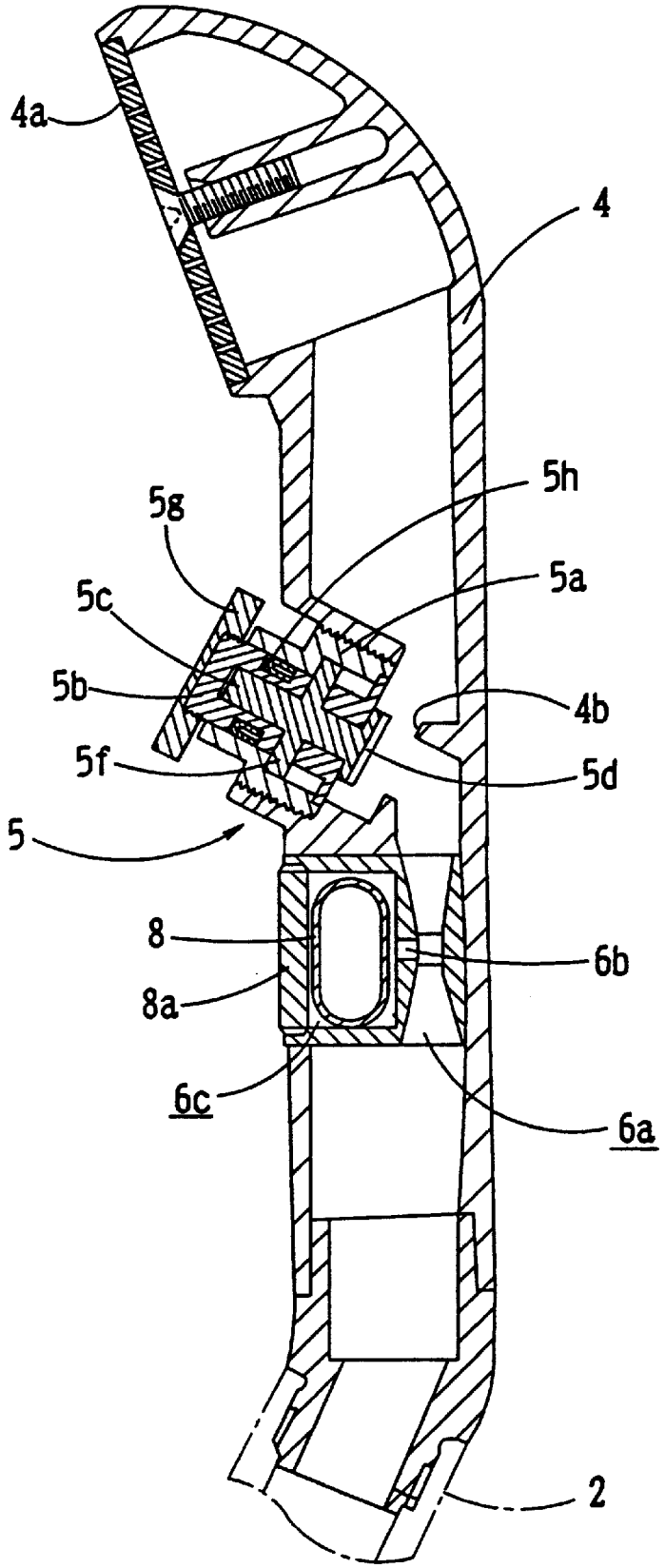
FIG. 14 is a longitudinal sectional view showing an example in which a tube is provided in the pressure absorbing mechanism instead of a piston.

FIG. 14 is an example in which a variable volume object whose internal volume can be varied is incorporated in the bore 6*c* instead of the piston 7 in the example in FIG. 11.

The example of such variable volume object shown in FIG. 14 is a tube 8 which is held by a plug 8*a* in the bore 6*c* shutting the bore 6*c* from the outside. In this case, when the tube 8 is employed, because of transmission of pressure into the bore 6*c* caused by a rise of internal pressure in the flow route after the opening valve 5 is closed, the tube 8 is contracted and deformed so that a volume communicating with the internal flow route side is expanded. Thus, like the example indicated in FIG. 11, it is possible to eliminate problems attendant the occurrence of water hammer and a steep rise of the internal pressure just after the valve is closed.

Alternatively, if a foamed substance which can be contracted and deformed due to an external pressure is incorporated instead of the tube 8, the same operation and effect can be obtained.

Figure 15:
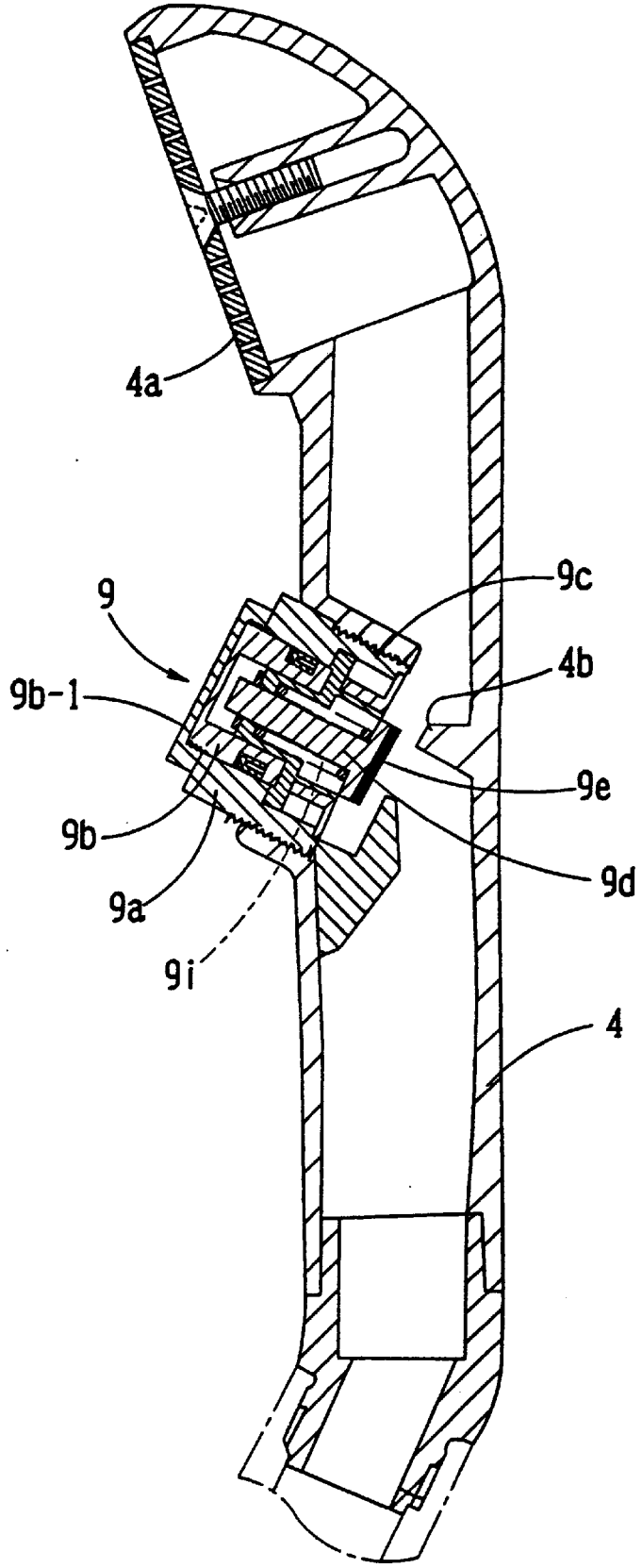
FIG. 15 is a longitudinal sectional view of an example containing a pressure absorbing mechanism for releasing a pressure in the upstream to the downstream after a valve closing operation is terminated.

FIG. 15 is an example employing a mechanism for releasing a pressure through a spray plate 4*a* to the atmosphere by temporarily setting the valve in the opening state by an increase in the internal pressure of the flow route in the upstream just after the valve is closed.

Like the examples shown in FIGS. 11 and 14, the opening valve 9 is provided at a position corresponding to the valve seat 4*b* formed in the main body 4.

Figure 16:
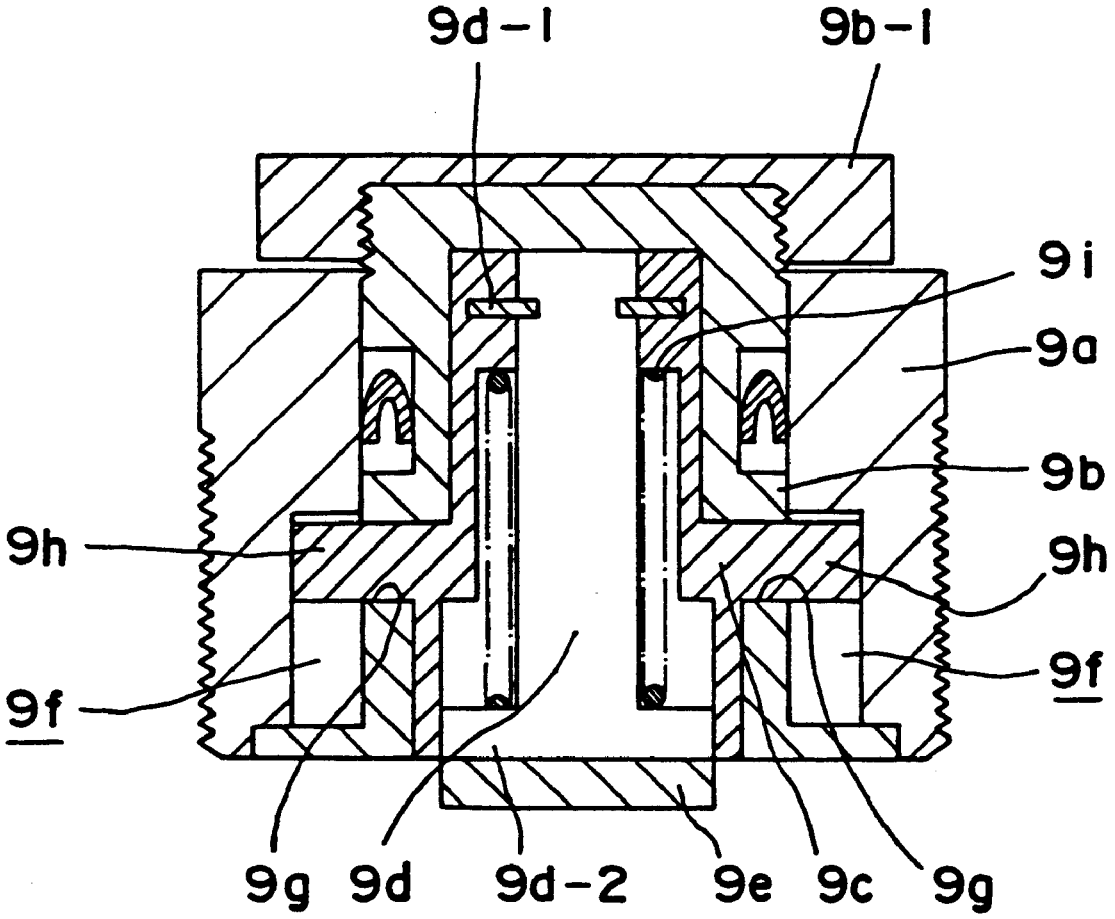
FIG. 16 is a longitudinal sectional view showing details of the opening valve shown in FIG. 15.
Figure 17:
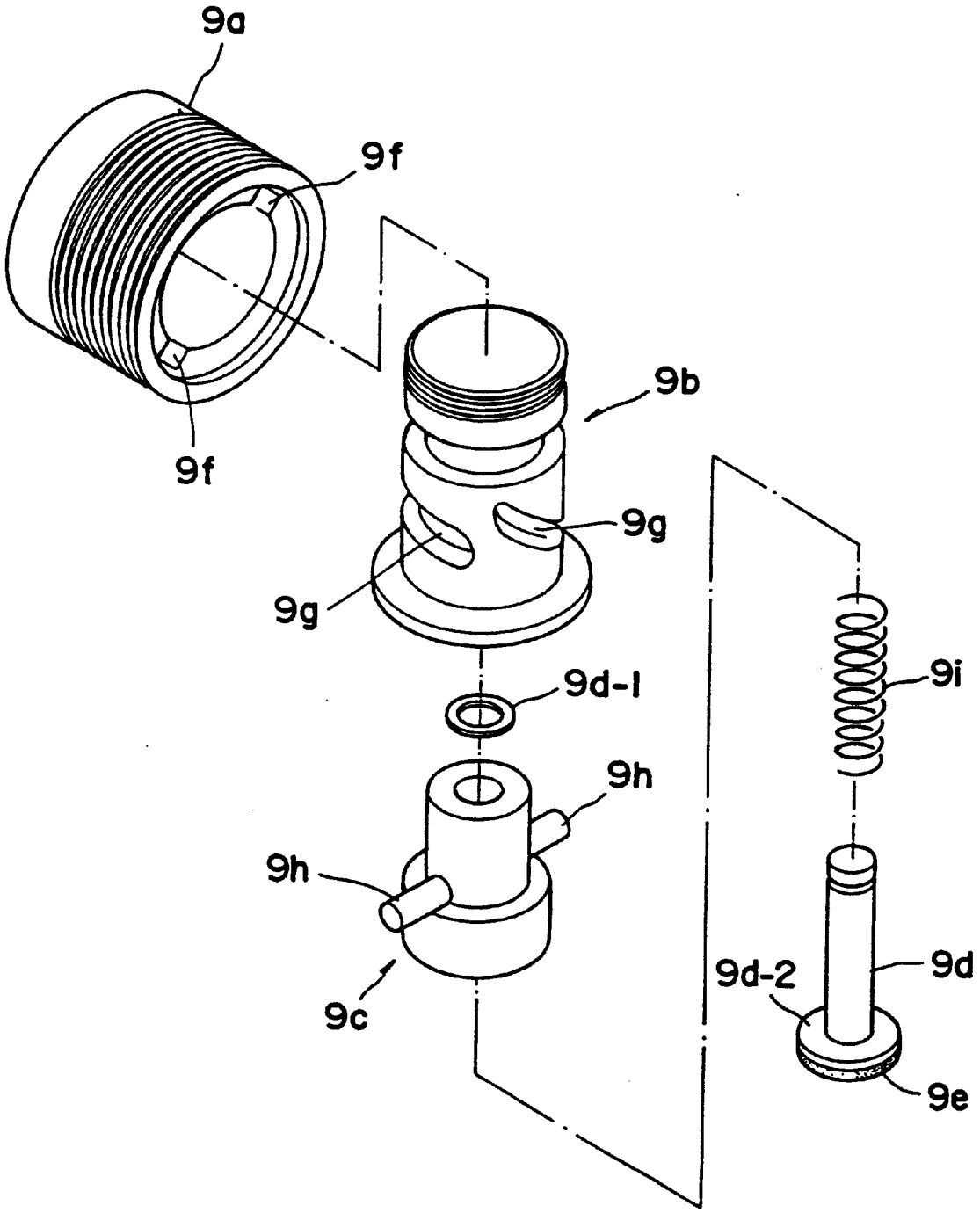
FIG. 17 is a perspective view showing disassembled parts of the opening valve shown in FIG. 15.

FIG. 16 is a longitudinal sectional view showing a detail of the opening valve 9 and FIG. 17 is a perspective view of disassembled components thereof. A guide ring 9*b* is incorporated into a sleeve 9*a* screwed to the main body 4 such that it is freely rotatable on the same axis. A moving element 9*c* is inserted into this guide ring 9*b* and a spindle 9*d* having a packing 9*e* at one end is movably incorporated in the moving element 9*c*.

A composition of the sleeve 9*a*, the guide ring 9*b* and the moving element 9*c* is almost the same as that shown in FIG. 12. Two holding grooves 9*f* are made in an internal circumference of the sleeve 9*a* and two oblique slit 9*g* are formed in an circumferential wall of the guide ring 9*b*. Two protrusions 9*h* which penetrate through these slits 9*g* and enter into the holding grooves 9*f* are formed so as to protrude from an external circumference of the moving element 9*c* in the radial direction. With this structure, if a knob 9*b*-1 provided on a top end of the guide ring 9*b* is rotated, the moving element 9*c* is not rotated around its axis but moved vertically as viewed in FIG. 9 because the protrusions 9*h* penetrating through the slit 9*g* are inserted into the holding grooves 9*f* of the sleeve 9*a*. As in the previous example, because of the inclination of the slit 9*g* in the guide ring 9*b*, the moving element 9*c* is moved rapidly merely by turning the knob 9*b*-1 a small amount.

The spindle 9*d* inserted into the moving element 9*c* is restricted from being moved downward or in the direction of valve closure by means of a ring 9*d*-1 engaging an external side face of the moving element 9*c*, and a compression coil spring 9*i* is incorporated between a flange 9*d*-2 on which a packing 9*e* is mounted at a top end portion of the guide ring 9*b*. Consequently, referring to FIG. 16, if a force pushing the packing 9*e* upward is applied, the spindle 9*d* contracts the spring 9*i* so that it moves upward with respect to the guide ring 9*b*, that is, in the opening direction of the valve.

If the opening valve 9, now in the state in which the valve is closed as shown in FIG. 15, is closed by means of the knob 9*b*-1, the moving element 9*c* and the spindle 9*d* are integrally moved toward the valve seat 4*b* so that the packing 9*e* is settled on the valve seat 4*b* to close the valve. If water hammer or a sudden increase in pressure occurs in the upstream of the opening valve 5 at this time, this pressure is received by the packing 9*e*. Thus, if a spring constant of the coil spring 9*i* is set to an appropriate level, it is possible to move only the spindle 9, now in the state in which the valve is closed as shown in FIG. 15, is closed by means of the knob 9*b*-1, the moving element 9*c* and the spindle 9*d* are integrally moved toward the valve seat 4*b* so that the packing 9*e* is settled on the valve seat 4*b* to close the valve. If water hammer or a sudden increase in pressure occurs in the upstream of the opening valve 5 at this time, this pressure is received by the packing 9*e*. Thus, if a spring constant of the coil spring 9*i* is set to an appropriate level, it is possible to move only the spindle 9*d* in a direction of being separated from the valve seat 4*b* by means of contraction of the coil spring 9*i* because of the increase in pressure. Thus, if the increase in pressure occurs upstream of the opening valve 5, this is not included in the flow route but can be released via the small holes in the spray plate 4*a* downstream.

By structuring the spindle 9*d* which can be set at the valve opening position and valve closing position such that it is movable in the opening direction of the valve by receiving a pressure from upstream when the valve is closed, it is possible to reduce the pressure load on the hose 2 due to water hammer or sudden increase in pressure.

Figure 18A:
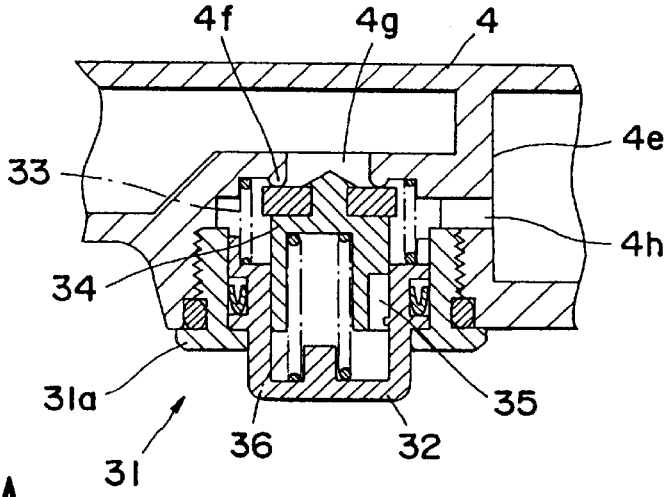
FIGS. 18(*a*) 18(*b*) and 18(*c*) are longitudinal sectional view of major parts showing another example of the opening valve which allows water to escape when pressure rises.
Figure 18B:
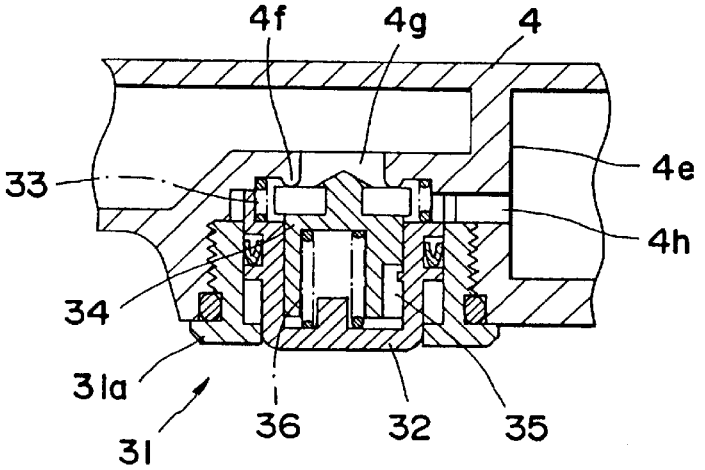
Figure 18C:
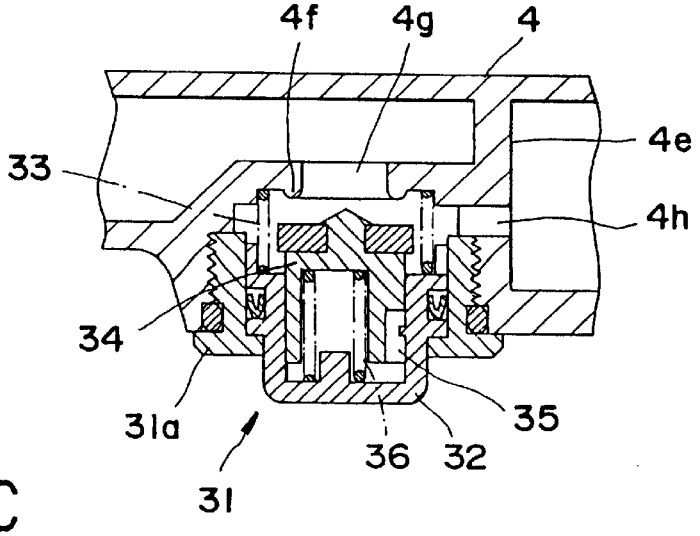

FIGS. 18(*a*), (*b*) and (*c*) are a longitudinal sectional view of major parts of other structures for allowing water to escape to the water spray side when an increase in pressure occurs upstream after the opening valve is closed as in FIG. 15.

The main body 4 of the shower head incorporates an opening valve 31 at the same position as in FIG. 15. The opening valve 31 can open and close a flow route connected between a valve hole 4*g* surrounded by a valve seat 4*f* provided on a partition wall 4*e* and a communicating hole 4*h* communicating with a side of the spray plate formed downstream, and is held by a bushing 31*a* fixed to the main body 4.

An operation button 32 is assembled into the bushing 31*a* in water-tight condition so that it can be moved in the direction of the valve seat 4*f*. This button is urged in the direction away from the main body 4 by a coil spring 33 disposed between the button 32 and the partition wall 4*e*. In the button 32, a valve body 34 capable of settling on the valve seat 4*f* is contained to communicate with the bushing 31*a* by means of a heart shaped cam 35 of conventional technology, and the valve body 34 is urged in the direction of the valve seat 4*f* by a coil spring 36. By a combination of the heart shaped cam 35 and the coil spring 36, the valve body 34 can be contained so as to communicate with the bushing 31*a* by means of a thrust lock mechanism of conventional technology applied, for example, to ball-point pens and the like.

With this thrust lock mechanism, if the button 32 is pressed in the state shown in FIG. 18(*a*), the button 32 is moved to a position shown in FIG. 18(*b*). If the pressing pressure is released, it is maintained in the state shown in FIG. 18(*c*). If the button 32 is pressed again in the state shown in FIG. 18(*c*), it is restored to the state shown in FIG. 18(*a*) through the state shown in FIG. 18(*b*). By pressing the button 32, it is possible to alternately switch to a state in which the valve body 34 is settled on the valve seat 4*f* as shown in FIG. 18(*a*) and a state in which the valve body 34 is separated from the valve seat 4*f* as shown in FIG. 18(*c*).

In the above embodiment, a value of the spring constant of the coil spring 36 urging the valve body 34 toward the valve seat 4*f* is selected such that it is contracted by a rise in pressure due to occurrence of water hammer upstream just after the opening valve 31 is closed. Thus, if an increase in pressure occurs just after the opening valve 31 is closed, the valve body 34 leaves the valve seat 4*f* as shown in FIG. 18(*c*) so that the flow route leading to the spray plate can be released. Consequently, as in the example shown in FIG. 15, it is possible to release the rise of the pressure by allowing water to escape. That is, according to this embodiment, the opening valve 31 which is provided as a flow amount adjusting means is provided with a pressure cushioning function, so that the flow amount adjusting means and the pressure cushioning means are combined.

FIG. 1 shows an example in which the pressure adjusting means and the pressure cushioning means are integrally structured, and FIG. 18 shows an example in which the flow amount adjusting means and the pressure cushioning means are integrally structured. Of course, it is possible to structure the pressure adjusting means, the flow amount adjusting means and the pressure cushioning means integrally.

Figure 19:
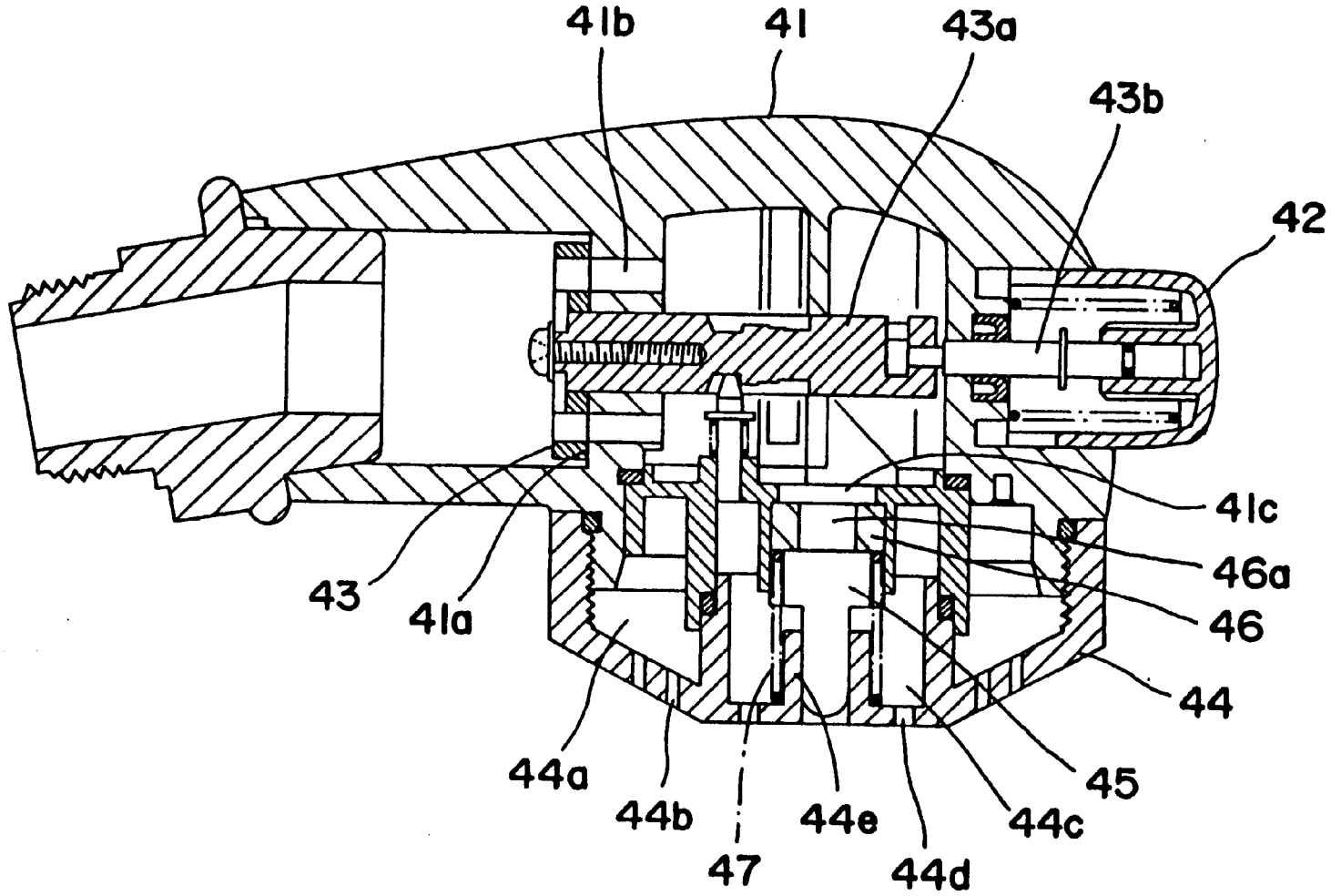
FIG. 19 is a longitudinal sectional view of major parts showing an example which is provided with a valve for water release at a spray plate of the shower head.

FIG. 19 shows an example in which an increase in pressure is suppressed by allowing water to escape through a spray plate in the shower head.

Unlike the previous examples, this shower head contains a button 42 disposed at a front end of a main body 41 for opening and closing. A plurality of valve holes (e.g., four holes at angular pitch of every 90° made in the valve seat 41*a* of the main body 41 are opened or closed, and a rotary type valve body 43 for switching the flow route is made to communicate with a button 42 by means of a cam shaft 43*a* and a rod 43*b*. The valve body 43 has two holes formed at an angular pitch of 180° which match with two valve holes 41*b* in the valve seat 41*a* at the same time.

A mechanism applied to a shower head disclosed in Japanese Patent application No Hei 5-170398, proposed by the same applicant, and the like can be applied directly for the opening operation and switch of a flow route by the valve 43 described above. If the handle 42 is pressed to the left side as viewed in FIG. 19, the valve body is turned at 90° until the valve body 43 is temporarily moved to the left and returned to its original position so that a combination between the valve body 43 and the valve hole 41*b* can be changed.

Alternatively, a spray plate 44 connected to a main body 41 is formed by forming an annular chamber 44*a* on an external circumference of the main body 41, and by making spray holes 44*b* in this annular chamber 44*a*, and then forming a discharging chamber 44*c*. The annular chamber 44*a* is made to communicate with two valve holes 41*b* located diagonally in the radial direction in the valve seat 41*a*, and the discharge chamber 44*c* is made to communicate with a flow route from the other two valve holes through a communication route 41*c*. Consequently, if the button 42 is pressed once, the flow route is changed to the annular chamber 44*a*. If this button 42 is pressed once more, the flow route is changed to the discharge chamber 44*c*. The structure is such that only when the flow route is changed to the annular chamber 44*c*, can shower spray from the spray holes 44*b* be obtained and that no shower spray can be obtained from the discharge chamber 44*c*. Then, the main body 41 is structured to have an opening valve composed of the valve seat 41*a* and the valve body 43.

The discharge chambers 44*c* have discharge holes 44*d* and a cylindrical guide 44*e* in the center thereof. In guide 44*d* is a relief valve body 45 which can be moved vertically as viewed in FIG. 19. This relief valve body 45 is urged toward a valve seat 46 located below a communication route 41*c* by means of a coil spring 47. At normal times, the relief valve 45 is settled on the valve seat 46 by this coil spring 47 so as to close the valve hole 46*a*.

If the button 42 is pressed when the flow route is communicating with the annular chamber 44*a*, as described previously, the valve body 43 is rotated so as to close the flow route to the annular chamber 44*a*, and then the flow route is changed to a communication route 41*c*. In the communication route 41*c*, as shown in FIG. 19, the relief valve 45 is settled on the valve seat 46 at normal times so that shower spray from the main body 41 is stopped by the above operation. That is, a state in which the flow route is switched to the communication route 41*c* corresponds to a state in which the valve is closed. Each time the button 42 is pressed, shower spray and stopping of water feeding are repeatedly switched.

Like the example shown in FIG. 18, the value of the spring constant of the coil spring 47 is selected such that it is contracted and deformed by a pressure received by the relief valve body 45 because of a rise in pressure due to water hammer just after the valve is closed. Consequently, when the pressure upstream rises after the valve is closed, the relief valve 45 leaves the valve seat 46 so as to open the valve, and water upstream is allowed to escape through the discharge holes 44*d*, thereby suppressing the rise in pressure.

Figure 20:
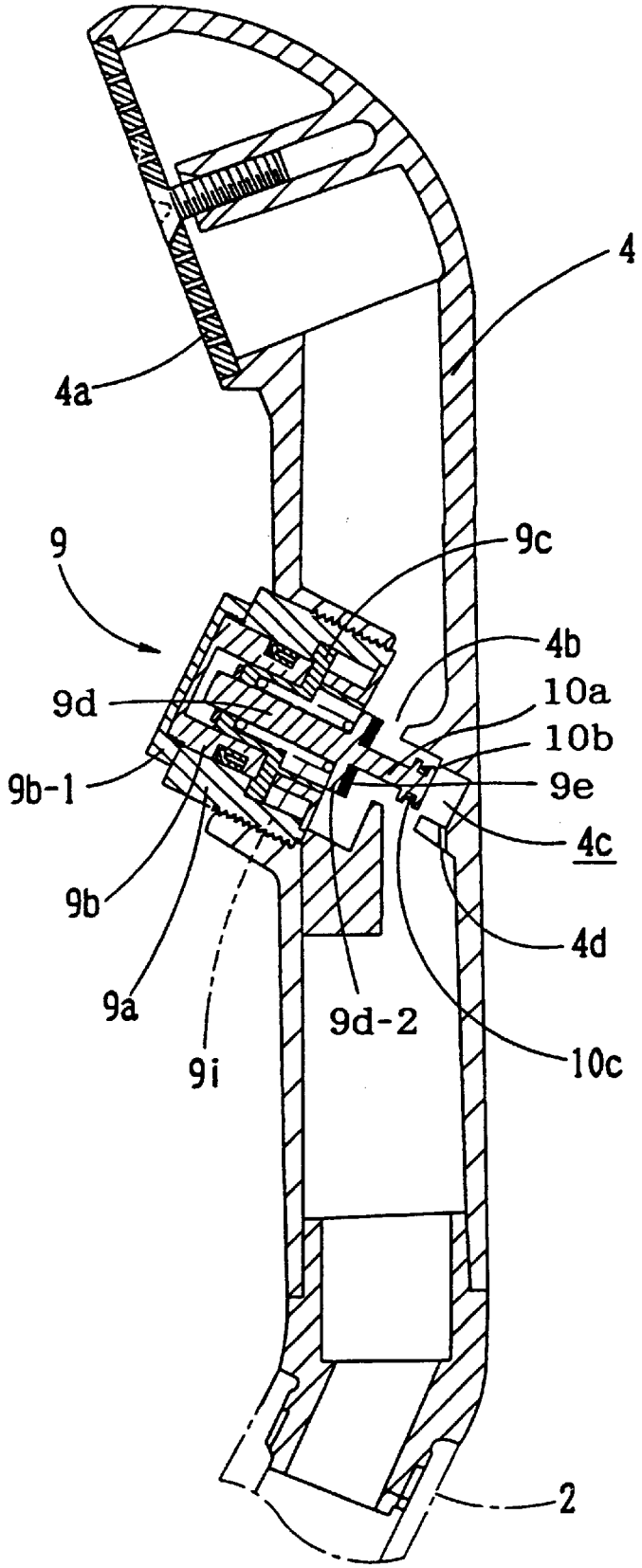
FIG. 20 is a longitudinal sectional view of an example of a mild stopping mechanism comprising a piston provided on a spindle of the opening valve and damper bore provided in the main body of the shower head.
Figure 21:
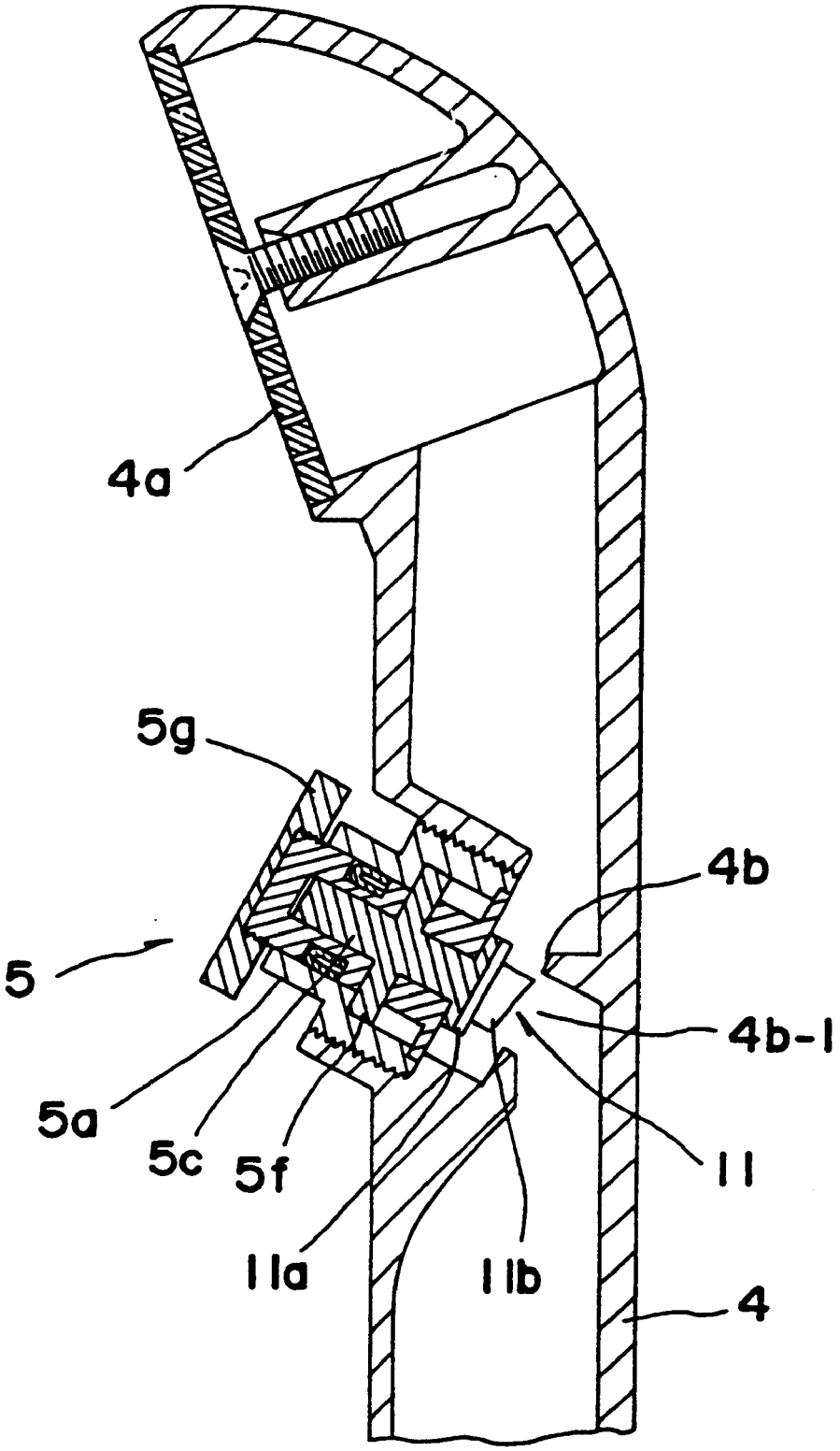
FIG. 21 is a longitudinal sectional view of an example in which mild closing of the opening valve is made possible by the shape of the packing of the opening valve.

FIG. 20 shows a practical embodiment in which an occurrence of water hammer is suppressed by cushioning the closing velocity of the valve to eliminate a sudden shutdown of the flow route.

With respect to the same figure, a construction for the opening/closing operation of the opening valve 9 is almost the same as that shown in FIG. 15, and the same reference numerals are utilized for the same members.

A spindle 9*d* has a rod 10*a* formed so as to protrude from a flange 9*d*-2 on which a packing 9*e* is mounted, the rod 10*a* being integrally formed on the same axis. At an end of the rod 10*a* a piston 10*b* is formed and on which a packing 10*c* is mounted over a circumference thereof.

A damper bore 4*c* having an opening axis coinciding with an axis of the spindle 9*d* is provided in an internal circumferential wall downstream of the valve seat 4*b* of the main body 4. This damper bore 4*c* has an internal diameter allowing the packing 10*c* to slidably fit, and a small hole 4*d* which is at the deepest bottom thereof communicating with the downstream.

When the opening valve 9 is closed by turning a knob 9*b*-1 as in the previous example, the spindle 9*d* is moved integrally with the guide ring 9*b* in the closing direction of the valve. If the front end of the spindle 9*d* is structured to be of sufficient length such that the piston 10*b* mounted thereon enters into the damper bore 4*c* before the packing 9*e* is settled on the valve seat 4*b*, the piston 10*b* is inserted into the damper bore 4*c* at the same time as the packing 9*e* is moved in the direction of the valve seat 4*b*.

Because mixing water is deposited in the damper bore 4*c*, if the piston 10*b* enters, this mixing water is discharged out through the small hole 4*d*. At this time, the piston 10*b* receives resistance by throttle of a flow route via the small hole 4*d*. Thus, the spindle 9*d* contracts the coil spring 9*i* when the moving element 9*c* is moved in the closing direction of the valve and the valve is closed at a velocity slower than that the motion of moving element 9*c* in the valveclosing direction. Thus, even if the knob 9*b*-1 is turned suddenly, the opening valve is not abruptly closed, thereby preventing an occurrence of water hammer due to a sudden shut-off of the flow route.

If the internal pressure upstream relative to the opening valve 5 is still high after the valve is closed, an operation of separating the packing 9*e* from the valve seat 4*b* by utilizing contraction of the coil spring 9*i* is enabled as indicated in the previous example, which is capable of releasing high residual pressure after the valve is closed.

The coil spring 9*i* is capable of improving the operability by cushioning resistance from the spindle 9*d* as well as decelerating the spindle 9*d* and releasing pressure when the valve is closed. Furthermore, the coil spring 9*i* is not always necessary but it is permissible that a rod and a piston are provided on the spindle 5*c* of the opening valve 5 shown in FIGS. 11 and 14 such that the piston is receivable within the damper bore of the main body 4. In this case also, it is possible to prevent an occurrence of water hammer by decelerating the valve closing speed.

Figure 22A:
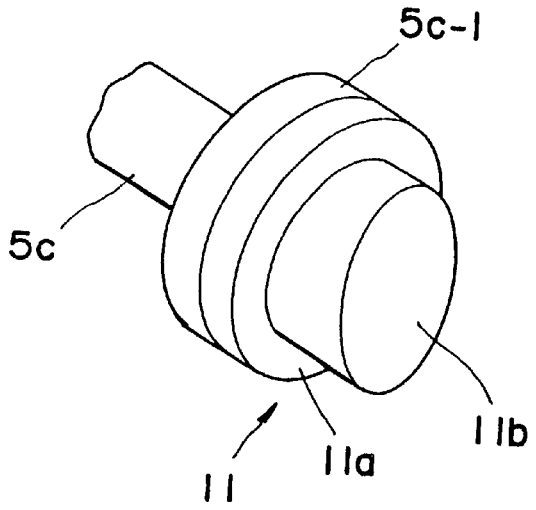
FIG. 22(*a*) is a detailed perspective view taken from the front end of a packing shown in FIG. 2.
Figure 22B:
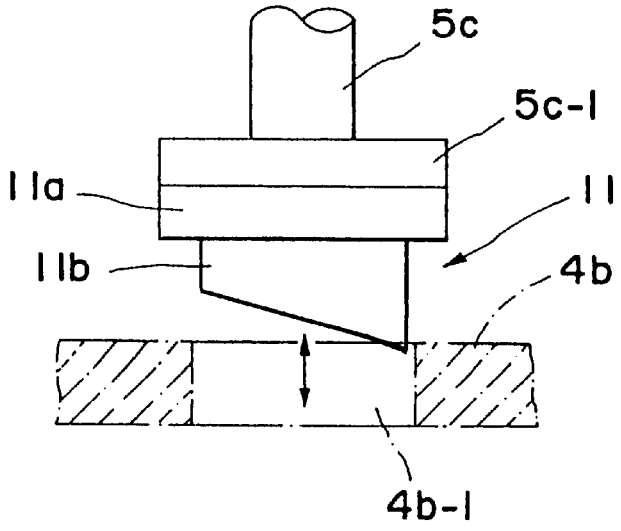

FIGS. 22(*a*) and (*b*) are an example in which an occurrence of water hammer is prevented by cushioning a shutdown of the flow route during a time interval from the start of valve closure to the completion thereof.

This example is essentially the same as the opening valve shown in FIGS. 11 and 14, with the exception of the opening valve 5 and the packing 5*h*. The same reference numerals correspond to the same components and a description thereof in detail is omitted.

A packing 11 provided at the front end of the spindle 5*c* comprises an annular seat 11*a* having substantially the same outside diameter as that of a flange 5*c*-1 as shown in FIGS. 22(*a*) and (*b*), an end face perpendicular to an axial line thereof and an insertion portion 11*b* coaxially protruding from the annular seat a front end face which is inclined relative to the axial line. The annular seat 11*a* has a size sufficient for covering the settling face of the valve seat 4*b*, and the insertion portion 11*b* has an outside diameter allowing it to be inserted into a valve hole 4*b*-1 surrounded by the valve seat 4*b* as shown in FIG. 22(*b*).

Since the packing 11 has such a structure, if the valve is closed by turning the knob 5*g* from the valve opening state shown in FIGS. 22(*a*) and (*b*) to the valve closing state, first, the insertion portion 11*b* is inserted into the valve hole 4*b*-1. At this time, an entire portion of the insertion portion 11*b* is not inserted into the valve hole 4*b*-1 but is inserted gradually from a portion having a long length up to the tip to a portion having a short length. Thus, when the operation of closing the valve is started, the area of the flow route from the valve hole 4*b*-1 to the settling face of the valve seat 4*b* is changed so as to be slightly smaller. As the insertion portion 11*b* is completely inserted into the valve hole 4*b*-1, a front end of the annular seat 11*a* approaches the settling face of the valve seat 4*b*. Thus, during this process, the area of the flow route is further decreased and, when the annular seat 11*a* settles on the valve seat 4*b* the flow route is completely shut down.

By utilizing the shape of the packing 11, the operation of closing the valve by throttling the area of the flow route gradually from a state in which the valve hole 4*b*-1 is completely opened is made possible in an interval of time from the start of closing the valve to the completion thereof. Thus, it is possible to prevent an occurrence of water hammer by slightly closing the flow route, as in the example shown previously in FIG. 20.

Alternatively, the shape of the insertion portion 11*b* may be a cone as well as a shape in which the front end thereof is cut diagonally relative to the axis as shown in FIGS. 22(*a*) and (*b*). In any case, if the valve is closed with the flow route area of such an annular section slightly decreasing when the insertion portion 11*b* is inserted into the valve hole 4*b*-1, any type thereof may be utilized.

In the respective examples described above, when the valve is closed by operating the main body 4 of the shower head, the increase in the internal pressure downstream is absorbed by a pressure absorbing mechanism incorporated in the main body 4, and also absorbed by the pressure adjusting valve 21 connected to the proximal end of the hose 2 as described in FIGS. 2 and FIGS. 3(*a*) and (*b*). Thus, the necessity of absorbing all pressure on the main body 4 of the shower head is eliminated, the space needed for pressure absorption can be reduced, and the volume of the main body 4 does not have to be increased.

Figure 23:
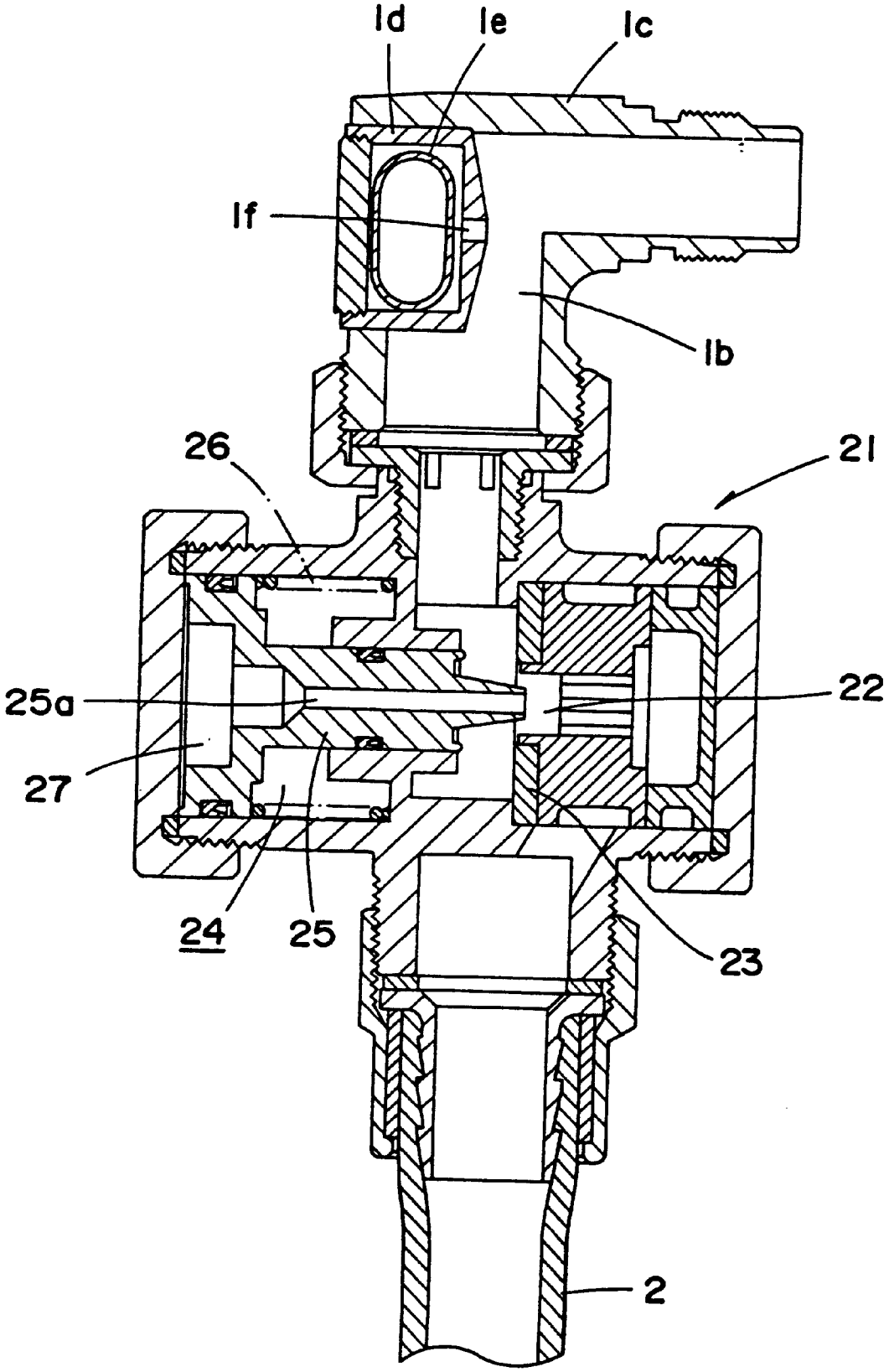
FIG. 23 is a longitudinal sectional view of major parts showing an example in which a block and a tube are provided as pressure cushioning means in the upstream of the pressure adjusting valve shown in FIG. 9.

FIG. 23 is an example in which a pressure cushioning means for reducing water hammer, which may occur when the control valve body 25 is closed, is provided in the mixing water exit 1*b* upstream of the pressure adjusting valve 21 shown in FIG. 9.

The pressure adjusting valve 21 shown in FIG. 23 is different only in that a mechanism for adjusting the initial load of the spring 26 shown in FIG. 9 is not contained therein. The remaining construction is the same. The pressure cushioning means shown in FIG. 14 is contained in an L-shaped joint 1*c* which is connected to the rear of the hot water/cold water mixing plug 1 as a member for composing the mixing water exit 1*b* communicating with the hot water/cold water mixing plug 1.

As a pressure cushioning means, as in the example shown in FIG. 14, a tube 1*e* filled with air is disposed in a block 1*d* incorporated in a bent portion of the joint 1*c*, and a small hole if is made in the block 1*d* to allow pressure from the flow route in the joint 1*c* to be transmitted to the tube 1*e*.

By providing the block 1*d* containing such a tube 1*e* in the joint 1*c*, when the control valve body 25 is closed by receiving a rise in pressure in the hose 2 accompanied by the operation of stopping of water feeding to the shower head 3 side, an increase in pressure in the flow route in the hot water/cold water mixing plug 1 is reduced by contraction and deformation of the tube 1*e*. Thus, impact to the valve mechanism in the hot water/cold water mixing plug 1 and cold water/hot water piping system in the building can be suppressed. Thus it is possible to reduce noises which otherwise occur in pipes.

As described above, according to the present invention, a pressure adjusting means for suppressing an increase in the internal pressure of the hose is provided at a portion which is on the fluid supply side and connected to the proximal portion of the hose and, further, a pressure cushioning means for suppressing an increase in the internal pressure when the valve provided in the main body of the shower head is closed is also provided in the main body of the shower head. Thus, when the opening valve is closed, water is stopped by the pressure adjusting means, and pressure is absorbed by expansion of the internal volume, and an increase in pressure is cushioned at the shower head side, thereby reducing the degree of change in the internal pressure to the hose. Consequently, repeated load on the hose is reduced and deterioration of the elasticity and damage of the sealing portion are prevented, thereby leading to an improvement in durability.

By incorporating a pressure cushioning means upstream of the pressure adjusting means, or by providing pressure adjusting means with a valve mechanism for cushioning an increase in pressure when water hammer occurs, pressure load on the water plug is reduced so that continued viability of the various parts of the shower apparatus composed of a water plug and hose is maintained.

The shower apparatus according to the present invention is capable of preventing an increase in the internal pressure of a flow route due to water hammer, which may occur when the flow route is closed or opened, in a piping system, in a water plug and building side, as well as in the hose up to the shower head.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

We claim:

1. A shower apparatus for suppressing an increase in pressure due to water hammer in a shower in which a supply fluid is provided to a shower head via a flow route extending from a supply to the shower head, the shower apparatus comprising:

pressure adjusting means for adjusting a pressure of the supply fluid;

flow adjusting means for adjusting an amount of flow of the supply fluid, said pressure adjusting means being disposed upstream of said flow adjusting means, pressure cushioning means for cushioning an increase in an internal pressure of the flow route which occurs when the flow route is closed by said flow adjusting means, said pressure cushioning means being disposed in communication with a portion of said flow route extending between said pressure adjusting means and said flow adjusting means to be operable as a flow route system capable of cushioning an increase in the internal pressure of said portion of the flow route when said flow adjusting means is operated to restrict flow through said shower head.

2. A shower apparatus according to claim 1, wherein the pressure cushioning means is disposed upstream of said pressure adjusting means.

3. A shower apparatus according to claim 1 or 2, wherein said flow adjusting means includes an opening valve disposed in said shower head, said opening valve including an operation portion.

4. A shower apparatus according to claim 3, wherein:

said opening valve includes a valve body;

the operation portion for the opening valve includes operating means for pressing said valve body to a valve closing position, said operating means being disposed to communicate with said valve body by means of a thrust lock mechanism; and said valve body can be set to an open position and the closing position each time said operating means is pressed.

5. A shower apparatus according to claims 1 or 2, wherein:

the pressure adjusting means comprises a control valve body capable of alternately opening and closing the flow route to the shower head and a pressure chamber formed on a side in which the control valve body is moved by receiving a flow route internal pressure on a hose side thereof, said pressure chamber allowing said valve body to move in water-tight conditions; and an internal volume of an internal flow route communicating with the hose side can be expanded by moving of said control valve body to said pressure chamber.

6. A shower apparatus according to claim 5, wherein the control valve body is structured such that when a stroke is taken thereby toward a valve seat to close said flow route, said control valve operates to gradually reduce an amount of flow passing through a valve hole on said valve seat corresponding to an increase of a stroke amount of the control valve body.

7. A shower apparatus according to claim 5, wherein:

said control valve body includes a communication route connecting said control valve body and a space formed therebehind with a valve hole of the valve seat on which the control valve body is settled and a downstream of the valve hole, an internal diameter of said communication route being in a range of about 0.3 mm–1.5 mm.

8. A shower apparatus according to claim 5, wherein:

said pressure adjusting means includes packing for blocking the flow route when the control valve body is settled thereon; and said packing has a hardness in a range of about 40–70 degrees.

9. A shower apparatus according to claims 1 or 2, wherein the pressure adjusting means comprises:

a valve hole made in a portion of the flow route extending between a fluid supply side and a hose side of the shower head;

a control valve body which is located downstream of the valve hole to make an end thereof wait, and which can be moved coaxially;

a pressure chamber for containing a proximal end portion of said control valve body in water-tight condition; and an elastic means for urging said control valve body in a direction that it leaves said valve hole, said control valve body further having a communication route for making a flow route on the side of the valve hole communicate with said pressure chamber so that said control valve body can be moved toward said valve hole while expanding the internal volume of said pressure chamber through a rise in pressure on the hose side, and said control valve body being further capable of moving between the front end of said control valve body and said valve hole in such a direction that will expand the internal volume of said pressure chamber even after said valve hole is closed by said control valve body.

10. A shower apparatus according to claim 1 or 2, wherein the pressure cushioning means further comprises a pressure absorbing means for absorbing an increase in pressure by one of a deviation in position and a deformation thereof in a direction resulting in expansion of a capacity of the flow route by receiving an increase in the internal pressure of the flow route.

11. A shower apparatus according to claim 10, wherein the pressure absorbing means is disposed upstream of the opening valve in the shower head and is constructed with a variable volume structure to expand a volume of an internal flow route in the shower head accompanied by an increase in the internal pressure of the flow route.

12. A shower apparatus according to claim 11, wherein the variable volume structure comprises:

a bore communicating with the internal flow route in the shower head;

a piston which is incorporated slidably in said bore in water-tight condition and which is made to wait in a portion communicating with the internal flow route while receiving the internal pressure of the flow route; and an elastic means for urging said piston against a load of said internal pressure.

13. A shower apparatus according to claim 11, wherein the variable volume structure comprises a bore communicating with the internal flow route in the shower head and a variable volume body which is filled in said bore, and which can be contracted and deformed by external pressure.

14. A shower apparatus according to claim 13 wherein the variable volume body is one of an elastically deformable hollow tube and a foamed substance.

15. A shower apparatus according to claim 12, wherein an orifice is provided to throttle a flow route area in the internal flow route, and where the bore is made to communicate with a throat portion of the orifice through a small hole.

16. A shower apparatus according to claim 1 or 2 wherein the pressure cushioning means includes a pressure relief means for releasing an increase in pressure to outside air by receiving the increase in the internal pressure of the flow route so that it is one of deviated in position and deformed in a direction of making the flow route open to the outside air.

17. A shower apparatus according to claim 16, wherein the pressure relief means is structured as a water escape mechanism in which a valve body of an opening valve is set to a valve opening position corresponding to an increase in pressure upstream when said valve body of the opening valve is located at a valve closing position.

18. A shower apparatus according to claim 17, wherein the opening valve employs a valve switching mechanism in which a discharge end side communicates when said opening valve is opened, and a flow route of the water stopping side communicates when the valve is opened, and includes a water escape mechanism in a flow route which is in an end of the water stopping side and communicates with the outside air.

19. A shower apparatus according to claim 17, wherein the water escape mechanism allows the valve body of the opening valve to be separated from the valve seat formed in the internal flow route by a stroke action in an axial direction, and includes an elastic means for urging the valve body in the direction of closing the valve, a maximum repellent force of said elastic means being slightly larger than the load of the minimum operating pressure of the pressure adjusting means acting on the valve body.

20. A shower apparatus according to claim 1, wherein the flow adjusting means includes an opening valve, and the pressure cushioning means is structured in a form of a mild stopping mechanism for causing a delay from the start of closing the flow route by means of the opening valve to a completion thereof.

21. A shower apparatus according to claim 20, wherein the opening valve includes a valve body and a valve seat formed in the internal flow route, and the mild stopping mechanism is structured such that the valve body of the opening valve can be fixed to and separated from the valve seat by a stroke action in the axial direction, the opening valve further including a damper bore in which a front end of the valve body can be inserted in water-tight condition in the direction of closing the opening valve, said damper bore containing a small hole for discharging fluid inside thereof to the internal flow route by inserting said valve body.

22. A shower apparatus according to claim 20, wherein the opening valve includes a valve body and a valve seat formed in the internal flow route, and the mild stopping mechanism is structured such that the valve body of the opening valve can be fixed to and separated from the valve seat by a stroke action in the axial direction, and a flow of fluid passing through the valve hole is gradually reduced accompanied by an increase in the stroke amount of the valve body in the direction of the valve seat.

* * * * *